US011417959B2

(12) United States Patent
Park et al.

(10) Patent No.: US 11,417,959 B2
(45) Date of Patent: Aug. 16, 2022

(54) CHIP ANTENNA MODULE AND ELECTRONIC DEVICE

(71) Applicant: Samsung Electro-Mechanics Co., Ltd., Suwon-si (KR)

(72) Inventors: Ju Hyoung Park, Suwon-si (KR); Won Cheol Lee, Suwon-si (KR); Sung Yong An, Suwon-si (KR); Kyu Bum Han, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 250 days.

(21) Appl. No.: 16/661,241

(22) Filed: Oct. 23, 2019

(65) Prior Publication Data

US 2020/0328518 A1 Oct. 15, 2020

(30) Foreign Application Priority Data

Apr. 11, 2019 (KR) ..... 10-2019-0042634
Jun. 13, 2019 (KR) ..... 10-2019-0069808

(51) Int. Cl.
*H01Q 9/04* (2006.01)
*H01Q 1/22* (2006.01)
*H01Q 5/40* (2015.01)

(52) U.S. Cl.
CPC ..... *H01Q 9/0414* (2013.01); *H01Q 1/2283* (2013.01); *H01Q 5/40* (2015.01)

(58) Field of Classification Search
CPC .... H01Q 1/2283; H01Q 1/521; H01Q 9/0414; H01Q 21/065
See application file for complete search history.

(56) References Cited

U.S. PATENT DOCUMENTS 5,003,318 A 3/1991 Berneking et al.
6,812,891 B2 11/2004 Montgomery et al.
(Continued)

FOREIGN PATENT DOCUMENTS

JP 9-232857 A 9/1997
JP 09232857 A * 9/1997
(Continued)

OTHER PUBLICATIONS

Korean Office Action dated Jan. 9, 2020 in counterpart Korean Patent Application No. 10-2019-0069808 (6 pages in English and 5 pages in Korean).
(Continued)

*Primary Examiner* — Andrea Lindgren Baltzell
*Assistant Examiner* — Amal Patel
(74) *Attorney, Agent, or Firm* — NSIP Law

(57) ABSTRACT

A chip antenna module includes: a solder layer disposed on a lower surface of the first dielectric layer; a first patch antenna pattern disposed on upper surface of the first dielectric layer and having a through-hole; a second patch antenna pattern spaced apart from an upper surface of the first patch antenna pattern and having an area less than an area of the first patch antenna pattern; a first feed via extending through the first dielectric layer and electrically connected to the first patch antenna pattern; a second feed via extending through the first dielectric layer and the through-hole, and electrically connected to the second patch antenna pattern; and shielding vias extending through the first dielectric layer, electrically connected to the first patch antenna pattern, and at least partially surrounding the second feed via.

20 Claims, 18 Drawing Sheets

(56) References Cited

U.S. PATENT DOCUMENTS

| | | | | |
|---|---|---|---|---|
| 8,749,434 | B2 | 6/2014 | Han et al. | |
| 2009/0207080 | A1* | 8/2009 | Floyd | H01L 23/66 343/700 MS |
| 2011/0102289 | A1 | 5/2011 | Leem | |
| 2012/0280860 | A1 | 11/2012 | Kamgaing et al. | |
| 2012/0287019 | A1 | 11/2012 | Sudo et al. | |
| 2016/0056544 | A1 | 2/2016 | Garcia et al. | |
| 2018/0159203 | A1 | 6/2018 | Baks et al. | |
| 2018/0219281 | A1 | 8/2018 | Sudo et al. | |
| 2019/0036232 | A1 | 1/2019 | Kang et al. | |
| 2019/0319364 | A1* | 10/2019 | Yang | H01Q 5/385 |
| 2019/0348749 | A1* | 11/2019 | Thai | H01Q 1/243 |
| 2020/0220270 | A1 | 7/2020 | Onaka et al. | |

FOREIGN PATENT DOCUMENTS

| | | | |
|---|---|---|---|
| JP | 5413467 | B2 | 2/2014 |
| JP | 2018-125704 | A | 8/2018 |
| KR | 10-1014352 | B1 | 2/2011 |
| KR | 10-1164618 | B1 | 7/2012 |
| KR | 10-1572037 | B1 | 11/2015 |
| KR | 10-2019-0013383 | A | 2/2019 |

OTHER PUBLICATIONS

U.S. Office Action dated Mar. 3, 2021 issued in counterpart Application, U.S. Appl. No. 16/739,177.

Korean Office Action dated Jun. 10, 2020 in the corresponding Korean Patent Application No. 10-2019-0099400 (6 pages in English, 5 pages in Korean).

U.S. Office Action dated Oct. 27, 2021 in U.S. Appl. No. 16/739,177. (11 pages in English).

* cited by examiner

CHIP ANTENNA MODULE AND ELECTRONIC DEVICE

CROSS-REFERENCE TO RELATED APPLICATIONS

This application claims the benefit under 35 U.S.C. § 119(a) of Korean Patent Application Nos. 10-2019-0042634 and 10-2019-0069808 filed on Apr. 11, 2019 and Jun. 13, 2019, respectively, in the Korean Intellectual Property Office, the entire disclosures of which are incorporated herein by reference for all purposes.

BACKGROUND

1. Field

The following description relates to a chip antenna module and an electronic device including a chip antenna module.

2. Description of Related Art

Mobile communications data traffic has been increasing rapidly on a yearly basis. Technology has been developed to support such rapid data transfer in real time in a wireless network. For example, the applications such as contents of Internet of Things (IoT)-based data, augmented reality (AR), Virtual Reality (VR), live VR/AR combined with SNS, autonomous driving, Sync View (real-time image transmission from the user's point view using an ultra-small camera), and the like, may require communications (for example: 5G communications, mmWave communications, and the like) supporting the transmission and reception of large amounts of data.

Thus, in recent years, millimeter wave (mmWave) communications including 5G communications have been researched, and research into the commercialization/standardization of chip antenna modules for smoothly implementing communications have been conducted.

An RF signal in a high frequency band (for example: 24 GHz, 28 GHz, 36 GHz, 39 GHz, 60 GHz, and the like) is easily absorbed in a process of transmission and may cause signal loss, and, therefore, a quality of communications may be reduced dramatically. Thus, an antenna for communications in a high frequency band requires a different approach from that of the conventional antenna technology, and special technological development such as providing an additional power amplifier for ensuring of an antenna gain, integration of an antenna and an RFIC, and ensuring effective isotropic radiated power (EIRP) may be required.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna module includes: a first dielectric layer; a solder layer disposed on a lower surface of the first dielectric layer; a first patch antenna pattern disposed on an upper surface of the first dielectric layer and having a through-hole; a second patch antenna pattern spaced apart from an upper surface of the first patch antenna pattern and having an area less than an area of the first patch antenna pattern; a first feed via extending from the lower surface of the first dielectric layer through the first dielectric layer, and electrically connected to the first patch antenna pattern; a second feed via extending from the lower surface of the first dielectric layer through the first dielectric layer and the through-hole, and electrically connected to the second patch antenna pattern; and shielding vias extending from the lower surface of the first dielectric layer through the first dielectric layer, electrically connected to the first patch antenna pattern, and arranged to at least partially surround the second feed via.

In one general aspect, a chip antenna module includes: a solder layer disposed on a lower surface of the first dielectric layer; a first patch antenna pattern disposed on upper surface of the first dielectric layer; a second patch antenna pattern spaced apart from the first patch antenna pattern and having an area less than an area of the first patch antenna pattern; a first feed via extending from the lower surface of the first dielectric layer through the first dielectric layer, and electrically connected to the first patch antenna pattern; a second feed via disposed from the first dielectric layer through the first dielectric layer and a through-hole of the first patch antenna pattern, and electrically connected to the second patch antenna pattern; and shielding vias extending from the first dielectric layer through the first dielectric layer, electrically connected to the first patch antenna pattern, and at least partially surrounding the second feed via.

The second feed via may include two or more second feed vias. The shielding vias may be arranged to at least partially surround the two or more second feed vias, respectively.

The first feed via may be offset from a center of the first patch antenna pattern. The second feed via may be disposed closer to the center of the first patch antenna pattern than the first feed via.

The chip antenna module may further include: a second dielectric layer disposed between the first and second patch antenna patterns, wherein a dielectric constant of the second dielectric layer is lower than a dielectric constant of the first dielectric layer.

A thickness of the second dielectric layer may be less than a thickness of the first dielectric layer.

The second dielectric layer may include a polymer. The first dielectric layer may include a ceramic.

The chip antenna module may further include: a third dielectric layer disposed above the second dielectric layer, wherein a dielectric constant of the third dielectric layer is higher than a dielectric constant of the second dielectric layer.

A thickness of the third dielectric layer may be greater than a thickness of the second dielectric layer and is less than a thickness of the first dielectric layer.

The chip antenna module may further include: a coupling patch pattern disposed on an upper surface of the third dielectric layer.

The chip antenna module may further include: a third dielectric layer disposed above the first dielectric layer, wherein a lower surface of the third dielectric layer forms an arrangement space of the second patch antenna pattern.

The chip antenna module may further include: a second dielectric layer disposed between the first and third dielectric layers; and an air cavity surrounded by the second dielectric layer.

The first patch antenna pattern may include two or more first patch antenna patterns. The first dielectric layer may be a single first dielectric layer overlapping each of the two or more first patch antenna patterns.

In another general aspect, an electronic device includes: chip antenna modules; a connection member including an upper surface to which a solder layer of each of the chip antenna modules is electrically connected; and an IC electrically connected to a lower surface of the connection member. At least one of the chip antenna modules includes: a first dielectric layer; a solder layer disposed on a lower surface of the first dielectric layer; a first patch antenna pattern disposed on an upper surface of the first dielectric layer and having a through-hole; a second patch antenna pattern spaced apart from an upper surface of the first patch antenna pattern and having an area less than an area of the first patch antenna pattern; a first feed via extending from the lower surface of the first dielectric layer through the first dielectric layer, and electrically connected to the first patch antenna pattern; a second feed via extending from the lower surface of the first dielectric layer through the first dielectric layer and the through-hole, and electrically connected to the second patch antenna pattern; and shielding vias extending from the lower surface of the first dielectric layer through the first dielectric layer, electrically connected to the first patch antenna pattern, and arranged to at least partially surround the second feed via.

The connection member may further include: a feed line electrically connecting the first feed via to the IC; a wiring ground plane at least partially surrounding the feed line; and a first ground plane disposed between the wiring ground plane and the chip antenna modules.

The connection member may further include: a second solder layer disposed above the first ground plane and electrically connected to the solder layer; and a peripheral via connecting the second solder layer to the first ground plane.

The connection member may further include: a first ground plane disposed below the chip antenna modules; and end-fire antennas having at least a portion that is non-overlapping with the first ground plane below the first ground plane.

In another general aspect, a chip antenna module includes: a first dielectric layer; a solder layer disposed on a lower surface of the first dielectric layer; a connection member comprising a ground plane connected to the solder layer; a first patch antenna pattern disposed on an upper surface of the first dielectric layer, and configured to transmit and receive signals in a first frequency band; a second patch antenna pattern disposed above the first patch antenna pattern, and configured to transmit and receive signals in a second frequency band different from the first frequency band; a first feed via extending through first dielectric layer, wherein one end of the first feed via is connected to a lower surface of the first patch antenna pattern, and another end of the first feed via is connected to the connection member; a second feed via extending through the first dielectric layer and a through-hole in the first patch antenna pattern, wherein one end of the second feed via is connected to a lower surface of the second patch antenna pattern, and another end of the second feed via is connected to the connection member; and shielding vias at least partially surrounding the second feed via in the first dielectric layer, wherein one end of each of the shielding vias is connected to the lower surface of first patch antenna pattern and another end of each of the shielding vias is connected to the connection member.

The chip antenna module may further include a third dielectric layer disposed on an upper surface of the second patch antenna pattern.

The chip antenna module may further include a second dielectric layer disposed between the first dielectric layer and the third dielectric layer, and having a dielectric constant lower than dielectric constants of the first dielectric layer and the third dielectric layer.

The first feed via may be offset from a center of the first patch antenna pattern by a distance greater than a distance by which the second feed via is offset from the center of the first patch antenna pattern.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
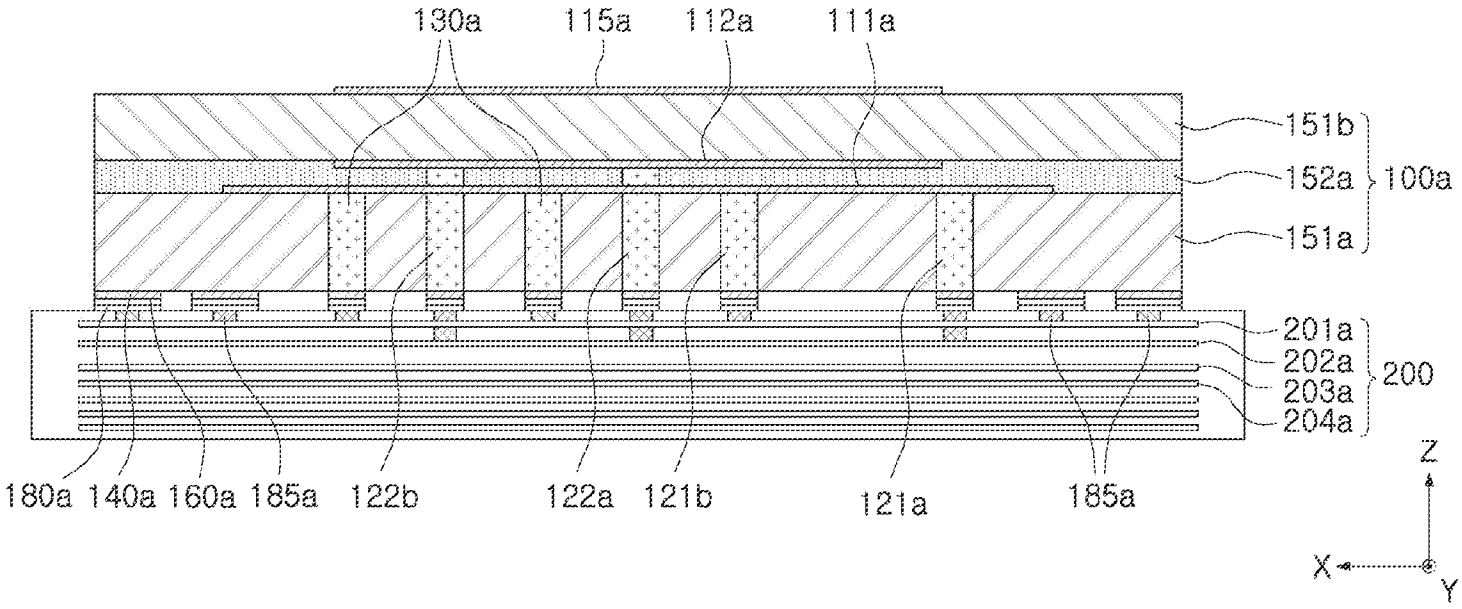
FIGS. 1A and 1B are side views illustrating chip antenna modules, according to embodiments.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

According to an aspect of the following description, a chip antenna module and an electronic device including a chip antenna module are capable of providing a transmitting and receiving device operable within a plurality of frequency bands that are different from each other, while improving antenna performance and/or easily implementing miniaturization of components.

Figure 2A:
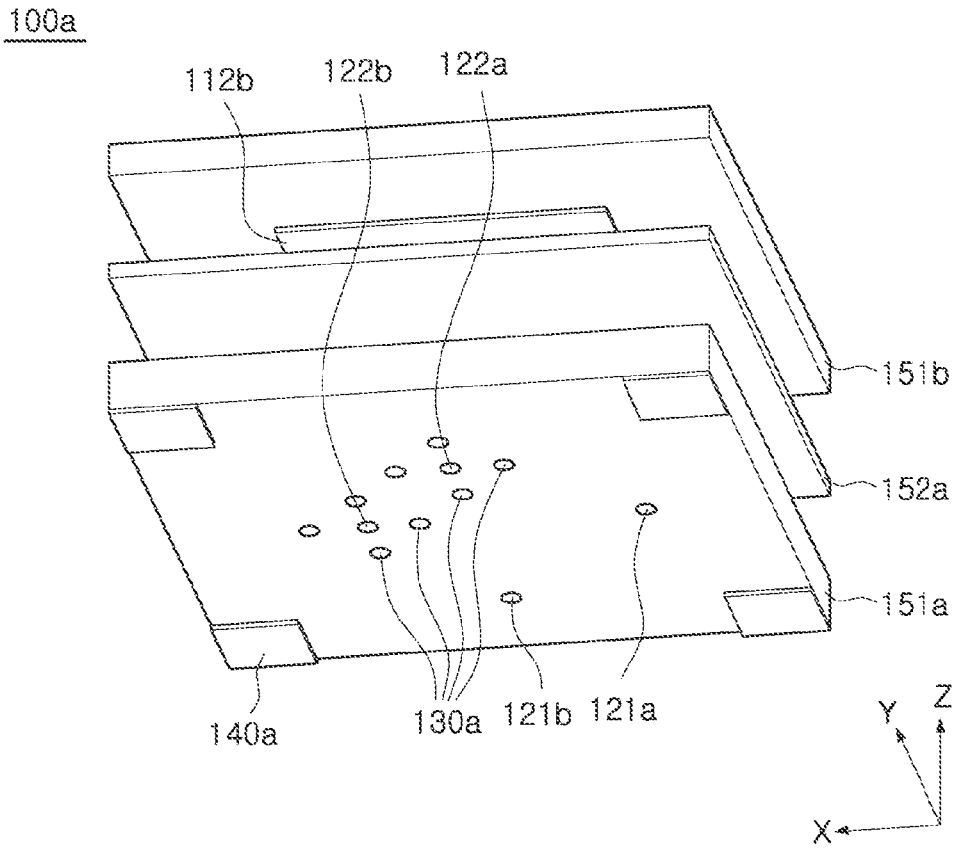
FIGS. 2A and 2B are perspective views illustrating the chip antenna module of FIG. 1A, according to an embodiment.
Figure 2B:
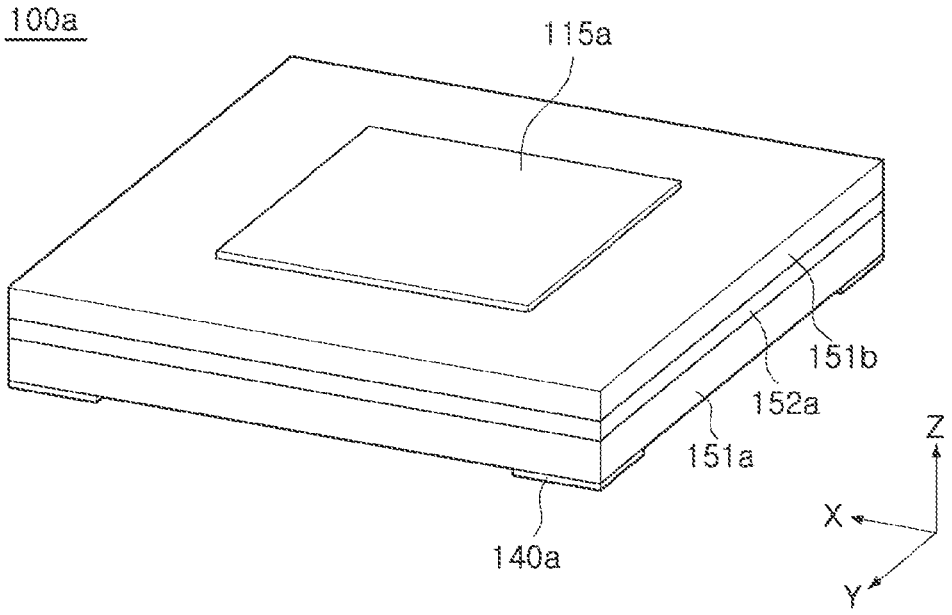
Figure 3:
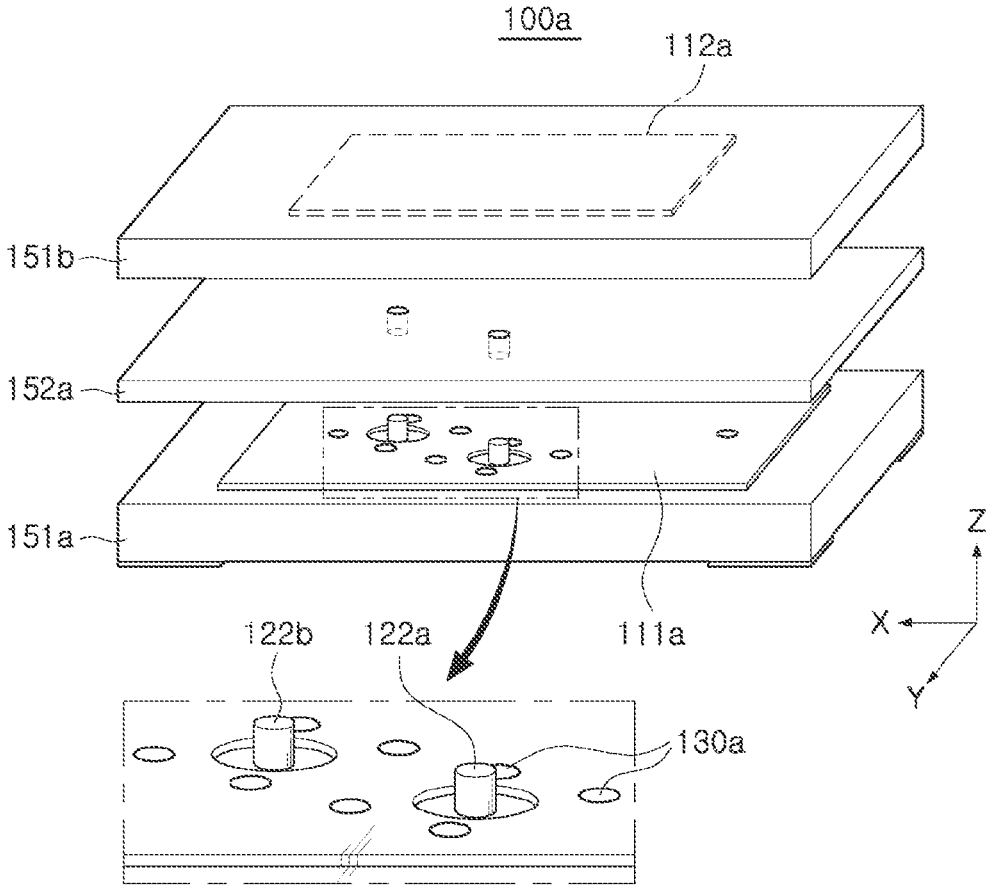
FIG. 3 is a perspective view illustrating shielding vias disposed in the chip antenna module of FIG. 1A, according to an embodiment.

FIG. 1A is a side view illustrating a chip antenna module 100*a*, according to an embodiment. FIGS. 2A and 2B are perspective views illustrating the chip antenna module 100*a*, according to an embodiment. FIG. 3 is a perspective view illustrating shielding vias 130*a* disposed in the chip antenna module 100*a*, according to an embodiment.

Referring to FIGS. 1A, 2A, 2B, and 3, the chip antenna module 100*a* may include a first patch antenna pattern 111*a* and a second patch antenna pattern 112*a*. Thus, the chip antenna module 100*a* may be transmitting and receiving device operable within a plurality of frequency bands that are different from each other. The chip antenna module 100*a* may further include a coupling patch pattern 115*a*, configured to widen a frequency bandwidth corresponding to the second patch antenna pattern 112*a*. The coupling patch pattern 115*a* may be omitted depending on bandwidth design conditions. For example, the coupling patch pattern 115*a* may have a slot. For example, at least one of the coupling patch pattern 115*a* and the first and second patch antenna patterns 111*a* and 112*a* may be rotated 45 degrees.

In addition, the chip antenna module 100*a* may include first feed vias 121*a* and 121*b*, as well as second feed vias 122*a* and 122*b*, and may be disposed on a first ground plane 201*a* of a connection member 200.

The first patch antenna pattern 111*a* is electrically connected to one end of each of the first feed vias 121*a* and 121*b*. Accordingly, the first patch antenna pattern 111*a* receives and transmits a first radio frequency (RF) signal in a first frequency band (for example: 28 GHz) from the first feed vias 121*a* and 121*b*, or receives a first RF signal and provides the first RF signal to the first feed vias 121*a* and 121*b*.

The second patch antenna pattern 112*a* is electrically connected to one end of each of the second feed vias 122*a* and 122*b*. Accordingly, the second patch antenna pattern 112*a* receives and transmits a second radio frequency (RF) signal in a second frequency band (for example: 39 GHz) from the second feed vias 122*a* and 122*b*, or receives a second RF signal and provides the second RF signal to the second feed vias 122*a* and 122*b*.

The first and second patch antenna patterns 111*a* and 112*a* are resonated with respect to the first and second frequency bands, respectively, so that energy corresponding to first and second signals is intensively received and radiated outwardly.

The first ground plane 201*a* may reflect first and second RF signals radiated toward the first ground plane 201*a*, among the first and second RF signals radiated by the first and second patch antenna patterns 111*a* and 112*a*. Thus, radiation patterns of the first and second patch antenna patterns 111*a* and 112*a* may be concentrated in a specific direction (for example: a z direction). Accordingly, gains of the first and second patch antenna patterns 111*a* and 112*a* may be improved.

Resonances of the first and second patch antenna patterns 111*a* and 112*a* may occur based on the resonance frequency according to a combination of an inductance and a capacitance corresponding to the first and second patch antenna patterns 111*a* and 112*a*, and surrounding structures.

A size (e.g., area) of an upper surface and/or a lower surface of each of the first and second patch antenna patterns 111*a* and 112*a* may affect the resonance frequency. That is, a size of an upper surface and/or a lower surface of each of the first and second patch antenna patterns 111*a* and 112*a* may be dependent on the first and second wavelengths corresponding to the first and second frequencies, respectively. If the first frequency is lower than the second frequency, the first patch antenna pattern 111*a* may be larger than the second patch antenna pattern 112*a*.

At least portions of the first and second patch antenna patterns 111*a* and 112*a* may overlap each other in a vertical direction (for example: a Z direction). Accordingly, since a size (e.g., length) of the chip antenna module 100*a* in a horizontal direction (for example: an X direction and/or a y direction) can be significantly reduced, the entirety of the chip antenna module 100*a* may be easily miniaturized.

The first and second feed vias 121*a*, 121*b*, 122*a*, and 122*b* are disposed to pass through at least one through-hole of the first ground plane 201*a*. Accordingly, one end of each of the first and second feed vias 121*a*, 121*b*, 122*a*, and 122*b* is located above the first ground plane 201*a*, while the other end of each of the first and second feed vias 121*a*, 121*b*, 122*a*, and 122*b* is located below the first ground plane 201*a*. The other end of each of the first and second feed vias 121*a*, 121*b*, 122*a*, and 122*b* is electrically connected to an integrated circuit (IC) mounted on a component mounting surface, so the first and second RF signals are provided to an IC or received from the IC. Electromagnetic isolation between the first and second patch antenna patterns 111*a* and 112*a* and the IC may be improved by the first ground plane 201*a*.

The first feed vias 121*a* and 121*b* include a first-1 feed via and a first-2 feed via, through which a first-1 RF signal and a first-2 RF signal, polarized by each other, pass, respectively, while the second feed vias 122*a* and 122*b* include a second-1 feed via and a second-2 feed via, through which a second-1 RF signal and a second-2 RF signal, polarized by each other, pass, respectively.

That is, each of the first and second patch antenna patterns 111*a* and 112*a* may transmit and receive a plurality of RF signals, and the plurality of RF signals may be a plurality of carrier signals with different pieces of data carried therein. Thus, a data transmission and reception rate of each of the first and second patch antenna patterns 111*a* and 112*a* may be improved twofold, according to transmission and reception of a plurality of RF signals.

For example, the first-1 RF signal and the first-2 RF signal have different phases (for example: 90 degrees or 180 degrees phase difference) to reduce interference with each other, and the second-1 RF signal and the second-2 RF signal have different phases (for example: 90 degrees or 180 degrees phase difference) to reduce interference with each other.

For example, the first-1 RF signal and the second-1 RF signal are perpendicular in a propagation direction (for example: a Z direction) and form an electric field and a magnetic field in an x direction and a y direction, perpendicular to each other, respectively. In addition, the first-2 RF signal and the second-2 RF signal form a magnetic field and an electric field in the X direction and the Y direction, respectively. Thus, polarization between the RF signals may be implemented. In the first and second patch antenna patterns 111*a* and 112*a*, a surface current, corresponding to the first-1 RF signal and the second-1 RF signal, and a surface current, corresponding to the first-2 RF signal and the second-2 RF signal, may flow perpendicular to each other.

Thus, the first-1 feed via and the second-1 feed via are connected adjacent to an edge in one direction (for example: the X direction) in the first and second patch antenna patterns 111*a* and 112*a*, while the. The first-2 feed via and the second-2 feed via are connected adjacent to an edge in another direction (for example: the Y direction) in the first and second patch antenna patterns 111*a* and 112*a*. However, specific connection points may vary depending on a design.

As an electrical length from the first and second patch antenna patterns 111*a* and 112*a* to the IC is reduced, the energy loss in the chip antenna module 100*a* of the first and second RF signals may be further reduced. Since a length in a vertical direction (for example: the Z direction) between the first and second patch antenna patterns 111*a* and 112*a* and the IC is relatively short, the first and second feed vias 121*a*, 121*b*, 122*a*, and 122*b* may easily allow an electrical connection distance between the first and second patch antenna patterns 111*a* and 112*a* and the IC to be reduced.

When at least portions of the first and second patch antenna patterns 111*a* and 112*a* overlap each other, the second feed vias 122*a* and 122*b* may be disposed to pass through the first patch antenna pattern 111*a* to be electrically connected to the second patch antenna pattern 112*a*.

Accordingly, transmission energy loss in the chip antenna module 100*a* of the first and second RF signals may be reduced, and connection points of the first and second feed vias 121*a*, 121*b*, 122*a*, and 122*b* in the first and second patch antenna patterns 111*a* and 112*a* may be more freely designed.

The connection points of the first and second feed vias 121*a*, 121*b*, 122*a*, and 122*b* may affect the transmission line impedance in terms of the first and second RF signals. As the transmission line impedance is matched more closely to a specific impedance (for example: 50 ohms), a reflection phenomenon in a process of providing the first and second RF signals may be reduced. Thus, when a degree of design freedom of connection points of the first and second feed vias 121*a*, 121*b*, 122*a*, and 122*b* is high, gains of the first and second patch antenna pattern 111*a*, 112*a* may be more easily improved.

However, since the second feed vias 122*a* and 122*b* are disposed to pass through the first patch antenna pattern 111*a*, radiation of the first RF signal, which is concentrated on the first patch antenna pattern 111*a*, may be affected. Accordingly, the electromagnetic isolation between the first and second RF signals may be deteriorated. The electromagnetic isolation may cause deterioration of gain of each of the first and second patch antenna patterns 111*a* and 112*a*.

Thus, the chip antenna module 100*a* includes a first patch antenna pattern 111*a* and a second patch antenna pattern 112*a*, and may further include the shielding vias 130*a* surrounding the second feed vias 122*a* and 122*b*.

The shielding vias 130*a* may be disposed to electrically connect the first patch antenna pattern 111*a* to the first ground plane 201*a*. Accordingly, the first RF signal radiated toward the second feed vias 122*a* and 122*b*, of the first RF signals radiated from the first patch antenna pattern 111*a*, may be reflected by the shielding vias 130*a*. Thus, the electromagnetic isolation between the first and second RF signals may be improved, and a gain of each of the first and second patch antenna patterns 111*a* and 112*a* may be improved.

The number and width of the shielding vias 130*a* are not particularly limited. If a distance of a space between the plurality of shielding vias 130*a* is less than a specific length (for example: a length dependent on a first wavelength of a first RF signal), the first RF signal may not substantially pass through a space between the plurality of shielding vias 130*a*. Accordingly, the electromagnetic isolation between the first and second RF signals may be further improved.

When the second feed vias 122*a* and 122*b* are provided, the shielding vias 130*a* may be arranged to surround second feed vias 122*a* and 122*b*, respectively.

Accordingly, as the electromagnetic isolation between the second feed vias 122*a* and 122*b* can be further improved, the electromagnetic isolation between the second-1 RF signal and the second-2 RF signal in the second patch antenna pattern 112*a* may be further improved, so an overall gain of the second patch antenna pattern 112*a* may be further improved.

The first feed vias 121*a* and 121*b* are offset in a first direction from the center of the first patch antenna pattern 111*a*, while the second feed vias 122*a* and 122*b* are located closer to the center of the first patch antenna pattern 111*a* than the first feed vias 121*a* and 121*b*. That is the first feed vias 121*a* and 121*b* may be offset from a center of the first patch antenna pattern 111*a* by a distance greater than a distance by which the second feed vias 122*a* and 122*b* are offset from the center of the first patch antenna pattern 111*a*.

Since the shielding vias 130*a* are electrically connected to the first patch antenna pattern 111*a*, a surface current of the first patch antenna pattern 111*a* may flow from a connection point of the first feed vias 121*a* and 121*b* to a connection point of the shielding vias 130*a*. Thus, because a surface current of the first patch antenna pattern 111*a* may be more concentrated on an edge of the first patch antenna pattern 111*a*, an RF signal of the first patch antenna pattern 111*a* may better avoid the second patch antenna pattern 112*a* to be remotely transmitted in the Z direction. That is, a phenomenon in which the second patch antenna pattern 112*a* interferes with radiation of the first patch antenna pattern 111*a* may be further reduced, and a gain of the first patch antenna pattern 111*a* may be further improved.

Additionally, referring to FIG. 1A, the chip antenna module 100*a* may further include at least one of the first dielectric layer 151*a* and the third dielectric layer 151*b*, as well as the second dielectric layer 152*a*, and may be mounted on the connection member 200. For example, the connection member 200 may have a stacked structure including at least a portion of the first ground plane 201*a*, the wiring ground plane 202*a*, the second ground plane 203*a*, and the IC ground plane 204*a*, and may be implemented as a printed circuit board (PCB).

The chip antenna module 100*a* and the connection member 200 may be separately manufactured, and may be physically coupled to each other after each of the chip antenna module 100*a* and the connection member 200 is manufactured.

Thus, the first dielectric layer 151*a*, the third dielectric layer 151*b*, and the second dielectric layer 152*a* may more easily be configured to have characteristics (for example: a dielectric constant Dk, a dielectric tangent Df, durability, and the like) different from characteristics of an insulating layer of the connection member 200. Thus, the chip antenna module 100*a* may have improved antenna characteristics (for example: a gain, a bandwidth, directivity, and the like) as compared to a size, and the connection member 200 may have an improved wiring performance of a feed line and a feed via (for example: torsional strength as compared to the number of stacked layers, a low dielectric constant, and the like).

The first dielectric layer 151*a* and the third dielectric layer 151*b* may be formed of a material having a dielectric constant higher than that of the second dielectric layer 152*a*. For example, the first dielectric layer 151*a* and the third dielectric layer 151*b* may be formed of a material such as a ceramic-based material, such as low temperature co-fired ceramic (LTCC), or a glass-based material, and may be configured to have a higher dielectric constant or stronger durability by further containing any one or any combination of any two or more of magnesium (Mg), silicon (Si), aluminum (Al), calcium (Ca), and titanium (Ti). For example, the first dielectric layer 151*a* and the third dielectric layer 151*b* may include $Mg_2SiO_4$, $MgAlO_4$, and $CaTiO_3$.

A lower surface of the first dielectric layer 151*a* may form an arrangement space of a solder layer 140*a*. The solder layer 140*a* is mounted on an upper surface of the connection member 200 to be physically coupled to the connection member 200.

For example, the chip antenna module 100*a* may be disposed to overlap the second solder layer 180*a* on which the solder layer 140*a* is disposed on an upper surface of the connection member 200. The second solder layer 180*a* is connected to the peripheral via 185*a* of the connection member 200, and thus has a strong binding force to the connection member 200. For example, the peripheral via 185*a* may connect the second solder layer 180*a* to the first ground plane 201*a*.

The solder layer 140*a* and the second solder layer 180*a* may be coupled to each other by a solder paste formed of a material with a low melting point such as tin (Sn). The solder paste may be inserted between the solder layer 140*a* and the second solder layer 180*a* at a temperature higher than a melting point of the solder paste. As a temperature is lowered, the solder paste may be form an electrical connection structure 160*a*. That is, the electrical connection structure 160*a* may electrically connect the solder layer 140*a* to the second solder layer 180*a*.

For example, in order to improve the coupling efficiency between the solder layer 140*a* and the second solder layer 180*a*, surfaces of the solder layer 140*a* and the second solder layer 180*a* may form a stacked structure of a nickel plated layer and a tin plated layer, but it is not limited thereto. That is, at least portions of the solder layer 140*a* and the second solder layer 180*a* may be formed using a plating process, and the first dielectric layer 151*a* may be configured to have characteristics suitable for the plating process of the solder layer 140*a* (for example: reliability for high temperature).

Additionally, a lower surface of the first dielectric layer 151*a* may provide a lead-out space of the first and second feed vias 121*a*, 121*b*, 122*a*, and 122*b* as well as the shielding vias 130*a*.

Thus, the electrical connection structure 160*a* having a relatively low melting point or having a relatively large width in a horizontal direction may be connected to a lower end of each of the first and second feed vias 121*a*, 121*b*, 122*a*, and 122*b* as well as the shielding vias 130*a*. For example, the electrical connection structure 160*a* may be provided as at least one of a solder ball, a pin, a land, and a pad, and may have a shape similar to that of the solder layer 140*a* depending on the design.

An upper surface of the first dielectric layer 151*a* may form an arrangement space of the first patch antenna pattern 111*a*.

A lower surface of the third dielectric layer 151*b* may form an arrangement space of the second patch antenna pattern 112*a*.

An upper surface of the third dielectric layer 151*b* may form an arrangement space of the coupling patch pattern 115*a*, and may be sealed by an encapsulant depending on the design.

The second dielectric layer 152*a* may be disposed on an upper surface of the first dielectric layer 151*a* or a lower surface of the third dielectric layer 151*b*, and may have a dielectric constant lower than a dielectric constant of the first dielectric layer 151*a* or a dielectric constant of the third dielectric layer 151*b*.

The second dielectric layer 152*a* may be formed of a material having a dielectric constant lower than a dielectric constant of an insulating layer of the connection member 200, such as a polymer, but is not limited thereto. For example, the second dielectric layer 152*a* may be formed of a ceramic, may be formed of a material having a high flexibility such as a liquid crystal polymer (LCP) or polyimide, may be formed of an epoxy resin having high strength or high adhesion, may be formed of a material having high durability such as Teflon, or may be formed of a material having high compatibility with the connection member 200, such as prepreg.

When the RF signal transmitted and received from the chip antenna module 100*a* passes through the first dielectric layer 151*a*, the third dielectric layer 151*b*, and the second dielectric layer 152*a*, the RF signal may have a wavelength based on dielectric constants of the first dielectric layer 151*a*, the third dielectric layer 151*b*, and the second dielectric layer 152*a*. That is, an effective wavelength of the RF signal in the chip antenna module 100*a* may become shorter according to high dielectric constants of the first dielectric layer 151*a* and the third dielectric layer 151*b*. An overall size of the chip antenna module 100*a* has a high correlation with a length of an effective wavelength of an RF signal. Thus, the chip antenna module 100*a* includes a first dielectric layer 151*a* and/or a third dielectric layer 151*b*, having a high dielectric constant, thereby having a reduced size without substantial deterioration of an antenna performance.

An overall size of the chip antenna module 100*a* may correspond to the arrangement number of chip antenna modules 100*a* per unit size of the first ground plane 201*a*. That is, as a size of the chip antenna module 100*a* is reduced, an overall gain and/or directivity of the antenna modules 100*a* may be improved.

On the other hand, since the second dielectric layer 152*a* has a relatively low dielectric constant, a wavelength of an RF signal at the second dielectric layer 152*a* may be long.

Each of a first interface between the second dielectric layer 152*a* and the first dielectric layer 151*a*, and a second interface between the second dielectric layer 152*a* and the third dielectric layer 151*b* may act as a boundary condition for an RF signal.

Due to a difference in dielectric constants between the first dielectric layer 151*a* and/or the third dielectric layer 151*b* and the second dielectric layer 152*a*, a propagation direction of an RF signal passing through the boundary condition may be refracted. As the difference in dielectric constants becomes greater, a degree of refraction of the RF signal may become greater.

Since the second dielectric layer 152*a* having a low dielectric constant is disposed between the first dielectric layer 151*a* and the third dielectric layer 151*b*, having high dielectric constants, a transmission and reception direction of each of the first and second RF signals may be more concentrated in the Z direction.

Since the first RF signal radiated from an upper surface of the first patch antenna pattern 111*a* is directed to a medium having a high dielectric constant from a medium having a low dielectric constant, a vector component of the first RF signal in a horizontal direction may be shortened. Thus, a radiation direction of the first patch antenna pattern 111*a* may be more concentrated in the Z direction. Accordingly, a gain of the first patch antenna pattern 111*a* may be improved.

Additionally, the first RF signal has a vector component relatively longer in a horizontal direction at the second dielectric layer 152*a*, and thus may better avoid the second patch antenna pattern 112*a* to be radiated in the Z direction. Accordingly, a phenomenon in which the second patch antenna pattern 112*a* interferes with radiation of the first patch antenna pattern 111*a* may be further reduced, and a gain of the first patch antenna pattern 111*a* may be further improved.

The second RF signal radiated from a lower surface of the second patch antenna pattern 112*a* may be propagated in the Z direction by reflection of the first ground plane 201*a* and/or the first patch antenna pattern 111*a*. In this case, the second RF signal is directed to a medium having a high dielectric constant from a medium having a low dielectric constant, and thus may be more concentrated in the Z direction. Accordingly, a gain of the second patch antenna pattern 112*a* may be improved.

As a result, the chip antenna module 100*a* may improve a gain of the first RF signal and a gain of the second RF signal.

A thickness of the second dielectric layer 152*a* may be less than a thickness of the first dielectric layer 151*a*. Accordingly, due to a relatively low dielectric constant of the second dielectric layer 152*a*, a remote transmission and reception direction of the first and second RF signals may be concentrated in the Z direction.

A thickness of the third dielectric layer 151*b* may be greater than a thickness of the second dielectric layer 152*a* and may be less than a thickness of the first dielectric layer 151*a*. Accordingly, a phenomenon in which the second patch antenna pattern 112*a* causes electromagnetic interference with the first patch antenna pattern 111*a* via the coupling patch pattern 115*a* may be further suppressed.

Figure 1B:
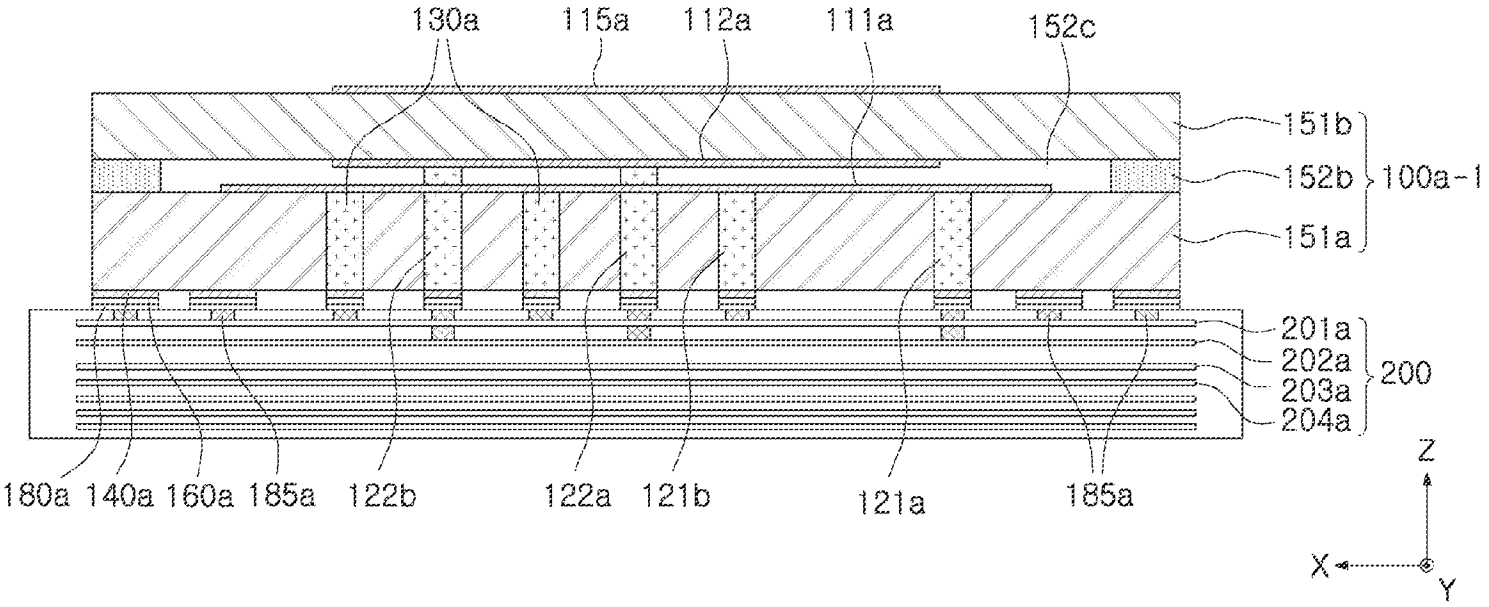

FIG. 1B is a side view illustrating a chip antenna module 100*a*-1, according to an embodiment.

Referring to FIG. 1B, in contrast to the chip antenna module 100*a* of FIG. 1A, the chip antenna module 100*a*-1 may include a second dielectric layer 152*b* and an air cavity 152*c*.

For example, the second dielectric layer 152*b* may be configured to surround the air cavity 152*c*, and may physically support a space between the first dielectric layer 151*a* and the third dielectric layer 151*b*.

Accordingly, a dielectric constant between the first and second patch antenna patterns 111*a* and 112*a* may be lower than a dielectric constant of the second dielectric layer 152*b*, and the first and second RF signals may be refracted more efficiently at an interface between the first dielectric layer 151*a* and the air cavity 152*c* due to a greater difference in dielectric constants between the first dielectric layer 151*a* and the air cavity 152*c*. Accordingly, a gain of the chip antenna module 100*a*-1 may be further improved.

Figure 4A:
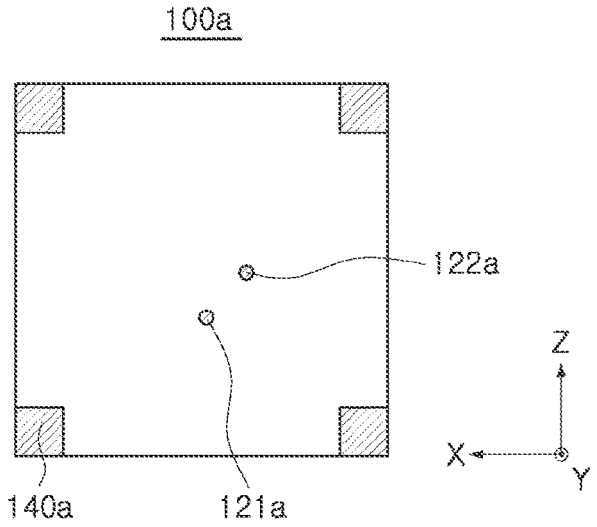
FIGS. 4A to 4C are plan views illustrating solder layers of a chip antenna modules, according to embodiments.
Figure 4B:
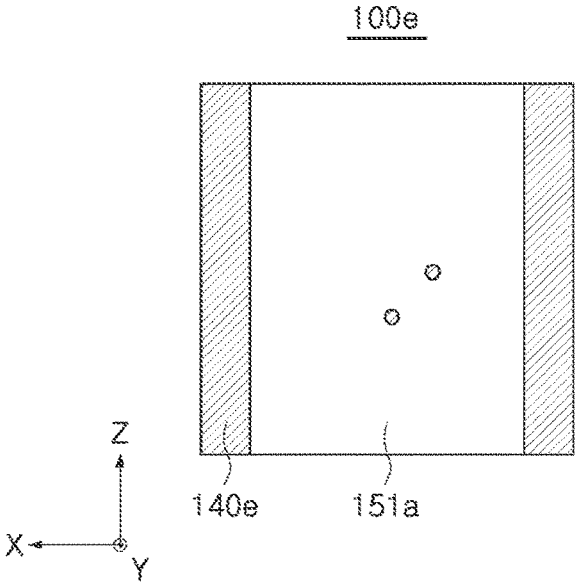
Figure 4C:
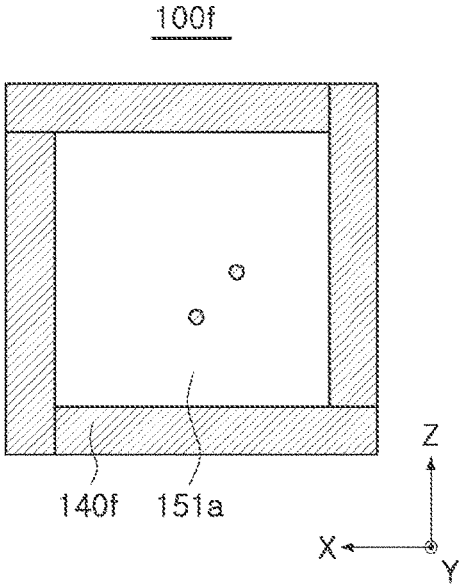

FIGS. 4A to 4C are plan views illustrating solder layers of chip antenna modules, according to an embodiments.

Referring to FIG. 4A, the solder layer 140*a* of the chip antenna module 100*a* may have a shape of a rectangular plate.

Referring to FIG. 4B, a solder layer 140*e* of a chip antenna module 100*e* may have a shape of a straight rod.

Referring to FIG. 4C, a solder layer 140*f* of a chip antenna module 100*f* according to an embodiment may have a shape of a guide ring surrounding an outer periphery of the chip antenna module 100*f*.

As a size of the solder layer 140*a*/140*e*/140*f* is increased, a bonding force to a connection member of the solder layer 140*a*/140*e*/140*f* may become stronger. Thus, a shape of the solder layers 140*a*, 140*e*, and 140*f* may be determined based on characteristics of the chip antenna modules 100*a*, 100*e*, and 100*f*, for example, the total arrangement number, the total number of patch antenna patterns, and the total number of vias. For example, the solder layers 140*a*, 140*e*, and 140*f* may have cylindrical shapes.

Figure 5A:
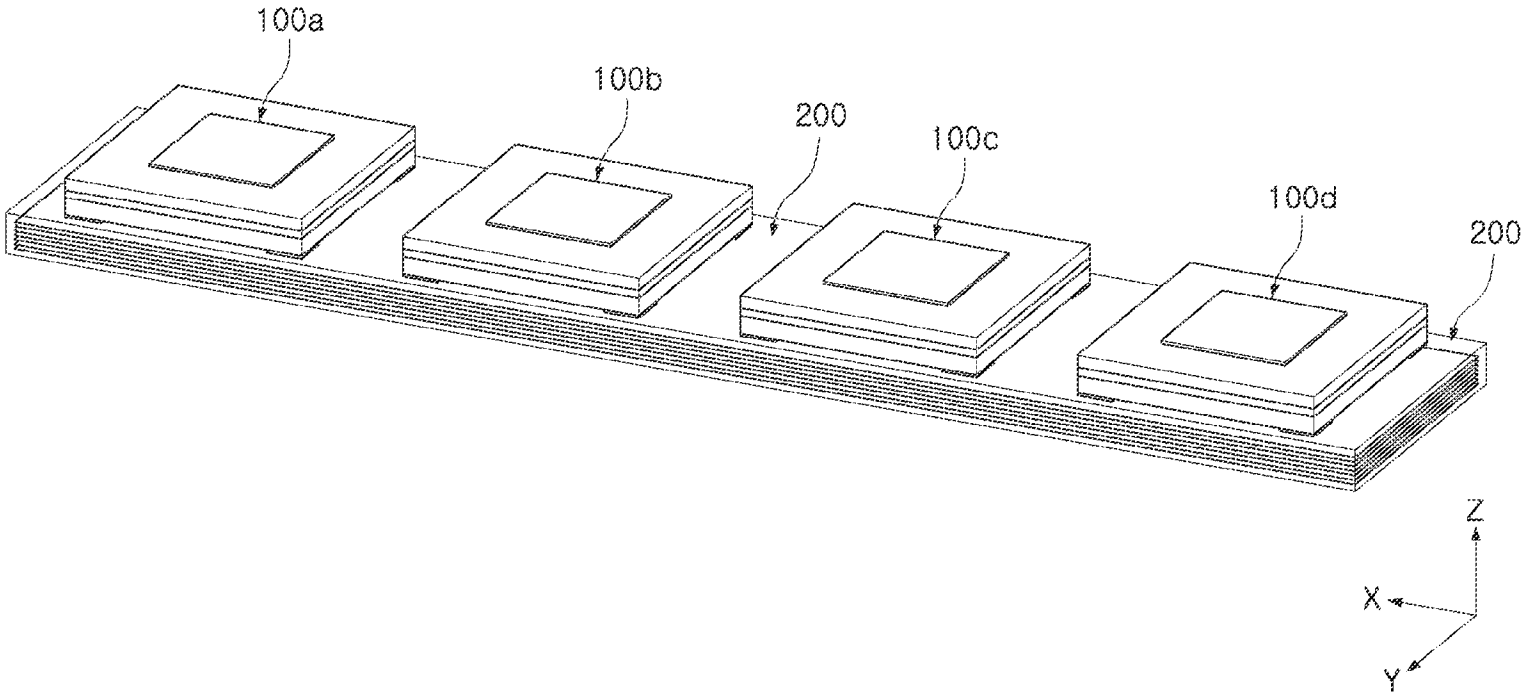
FIG. 5A is a perspective view illustrating the arrangement of chip antenna modules, according to an embodiment.

FIG. 5A is a perspective view illustrating the arrangement of chip antenna modules 100*a*, 100*b*, 100*c*, and 100*d*, according to an embodiment.

Referring to FIG. 5A, the chip antenna modules 100*a*, 100*b*, 100*c*, and 100*d* may be arranged in a [1×n] structure, where n is a natural number.

A space between adjacent chip antenna modules among the chip antenna modules 100*a*, 100*b*, 100*c*, and 100*d* may be formed of air having a dielectric constant lower than that of each dielectric of the chip antenna modules 100*a*, 100*b*, 100*c*, and 100*d*, or an encapsulant.

A side surface of each of the chip antenna modules 100*a*, 100*b*, 100*c*, and 100*d* may act as a boundary condition with respect to an RF signal. Thus, when the chip antenna modules 100*a*, 100*b*, 100*c*, and 100*d* are arranged spaced apart from each other, the electromagnetic isolation with respect to each of the chip antenna modules 100*a*, 100*b*, 100*c*, and 100*d* may be improved.

Figure 5B:
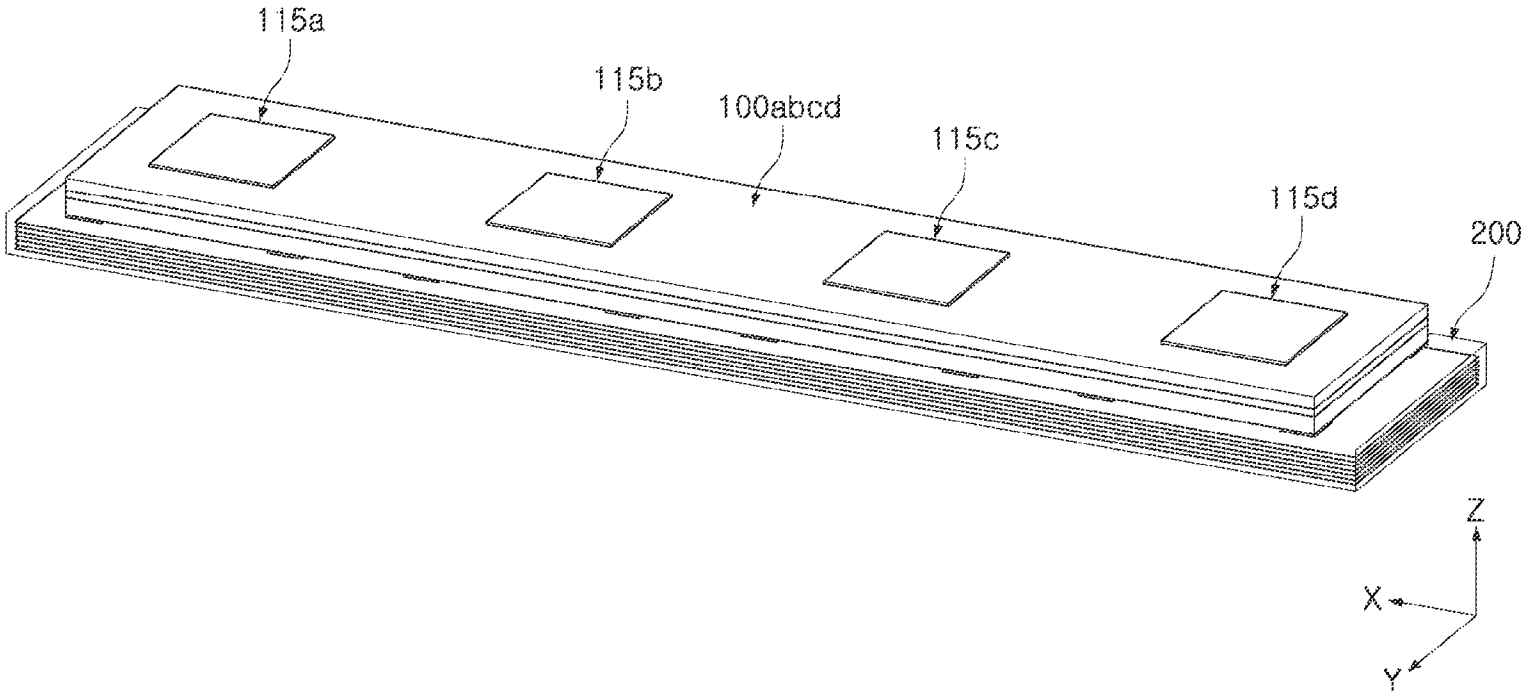
FIG. 5B is a perspective view illustrating an integrated chip antenna module in which chip antenna modules are integrated, according to an embodiment.

FIG. 5B is a perspective view illustrating an integrated chip antenna module 100*abcd* in which chip antenna modules are integrated.

Referring to FIG. 5B, the integrated chip antenna module 100*abcd* according to an embodiment may have a structure in which chip antenna modules illustrated in FIGS. 1A to 5A are integrated.

That is, the first dielectric layer may be configured as a single first dielectric layer overlapping each of the first patch antenna patterns depending on the design. The first patch antenna patterns may be arranged parallel to the integrated chip antenna module 100*abcd* to overlap coupling patch patterns 115*a*, 115*b*, 115*c*, and 115*d* in the Z direction.

Accordingly, an overall size of the integrated chip antenna module 100*abcd* may be reduced.

The electromagnetic interference, which the first feed vias (e.g., the first feed vias 121*a* and 121*b* provide to each other, may be reduced by the shielding vias (e.g., the shielding vias 130*a*) described above. Thus, the integrated chip antenna module 100*abcd* may have a further reduced size while preventing deterioration of an antenna performance caused by a reduction in a size.

Figure 6A:
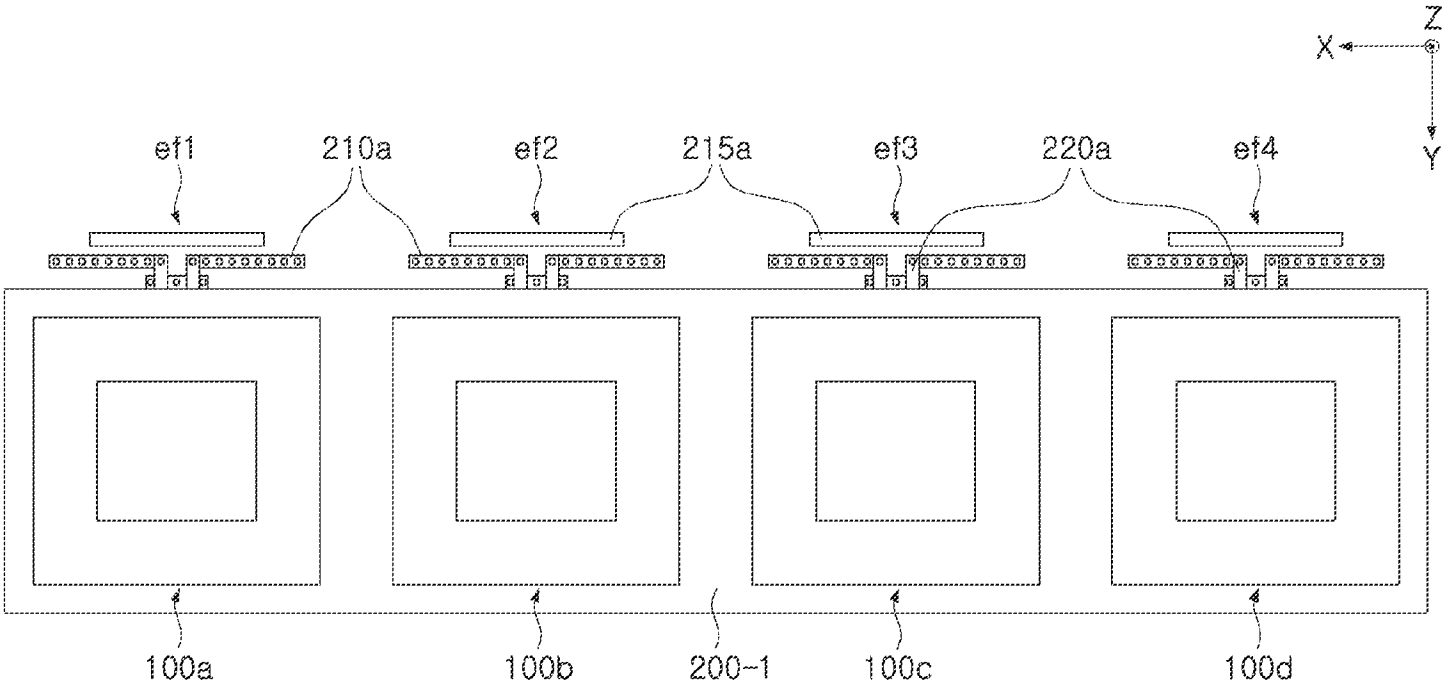
FIG. 6A is a plan view illustrating end-fire antennas included in a connection member disposed below chip antenna modules, according to an embodiment.

FIG. 6A is a plan view illustrating end-fire antennas ef1, ef2, ef3, and ef4 included in a connection member 200-1 disposed below the chip antenna modules 100*a*, 100*b*, 100*c*, and 100*d*, according to an embodiment.

Referring to FIG. 6A, the connection member 200-1 may include the end-fire antennas ef1, ef2, ef3, and ef4, arranged parallel to the chip antenna modules 100*a*, 100*b*, 100*c*, and 100*d*, and may form a radiation pattern of an RF signal in a horizontal direction (for example: the X direction and/or the Y direction).

Each of the end-fire antennas ef1, ef2, ef3, and ef4 includes end-fire antenna patterns 210*a* and a feed line 220*a*, and may further include a director pattern 215*a*.

The chip antenna modules 100*a*, 100*b*, 100*c*, 100*d* include shielding vias, arranged to surround a first feed via, and thus improve the electromagnetic isolation with respect to the end-fire antennas ef1, ef2, ef3, and ef4. Accordingly, gains of the chip antenna modules 100*a*, 100*b*, 100*c*, and 100*d* may be further improved.

Figure 6B:
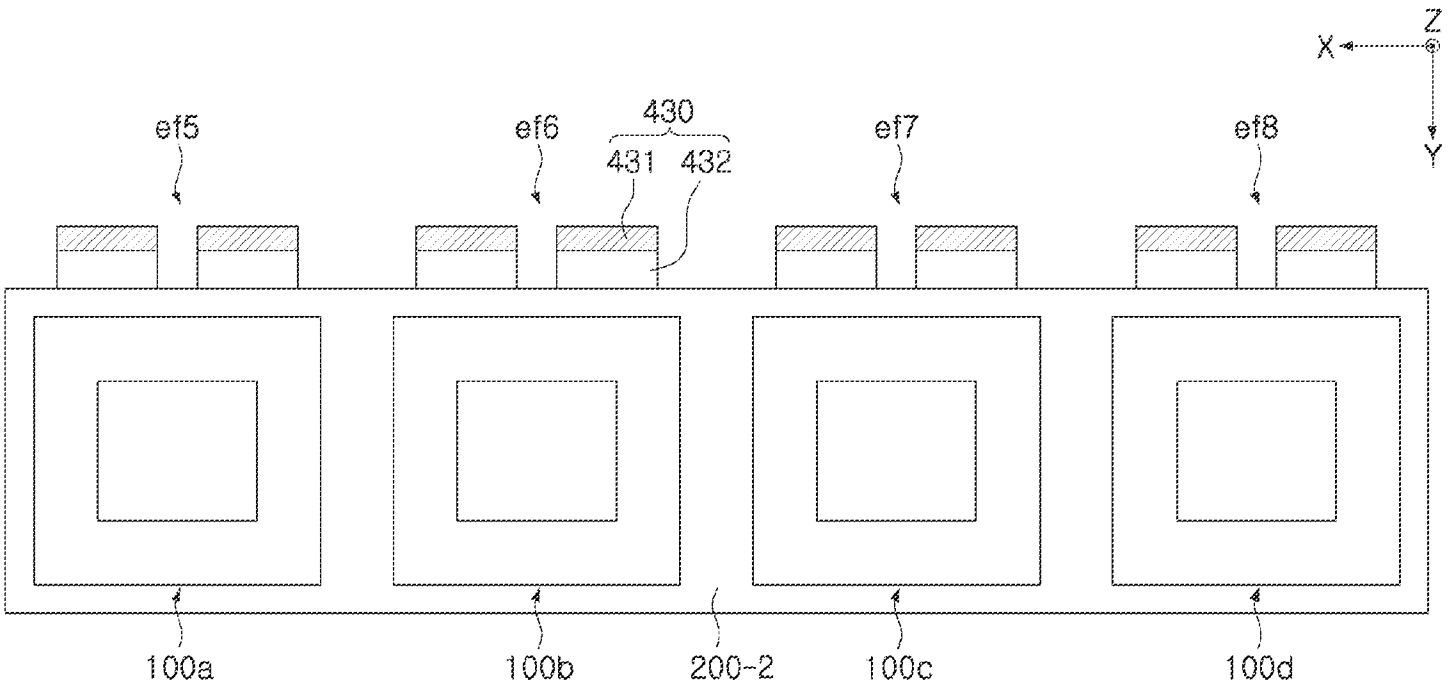
FIG. 6B is a plan view illustrating end-fire antennas disposed in a connection member disposed below chip antenna modules, according to an embodiment.

FIG. 6B is a plan view illustrating end-fire antennas ef5, ef6, ef7, and ef8 disposed in a connection member 200-2 disposed below the chip antenna modules 100*a*, 100*b*, 100*c*, and 100*d*, according to an embodiment.

Referring to FIG. 6B, the connection member 200-2 may include end-fire antennas ef5, ef6, ef7, and ef8 arranged parallel to the chip antenna modules 100*a*, 100*b*, 100*c*, and 100*d*, and thus may form a radiation pattern of an RF signal in a horizontal direction (for example: the X direction and/or the Y direction).

Each of the end-fire antennas ef5, ef6, ef7, and ef8 may include a radiator 431 and a dielectric 432.

Figure 7A:
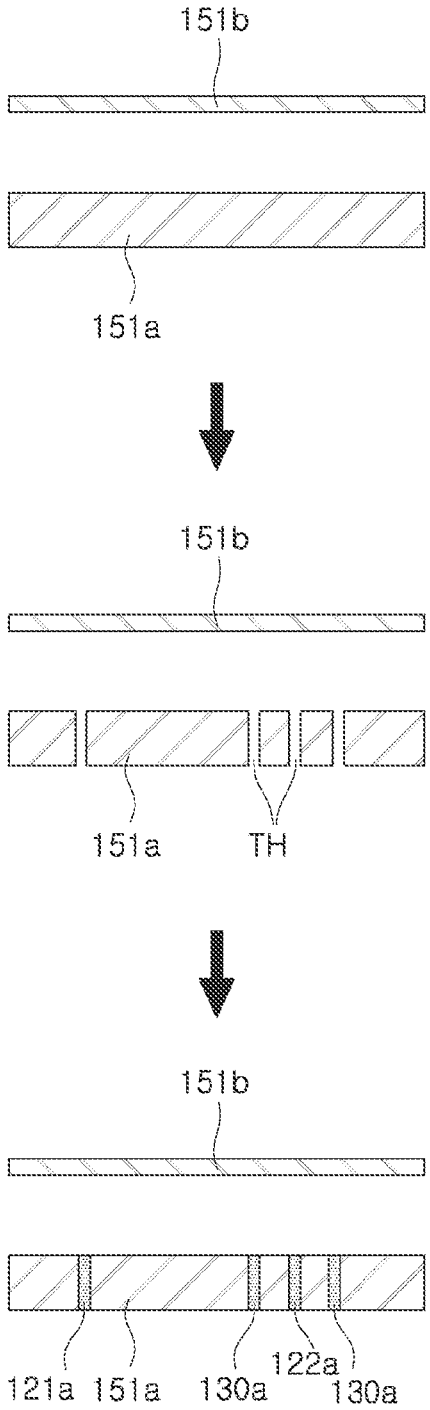
FIGS. 7A to 7C are views illustrating a method of manufacturing a chip antenna module, according to an embodiment.
Figure 7B:
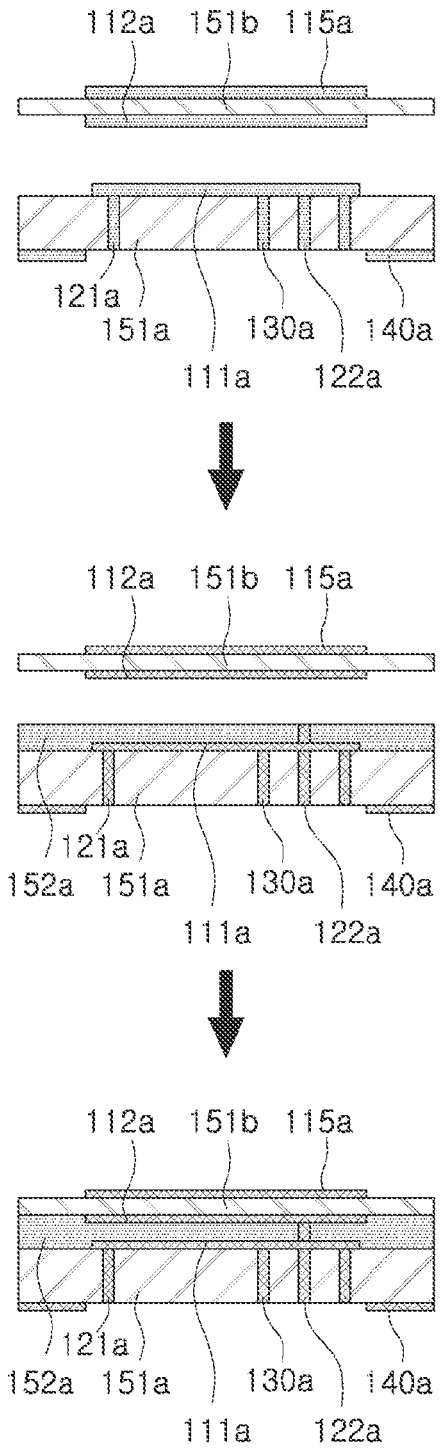
Figure 7C:
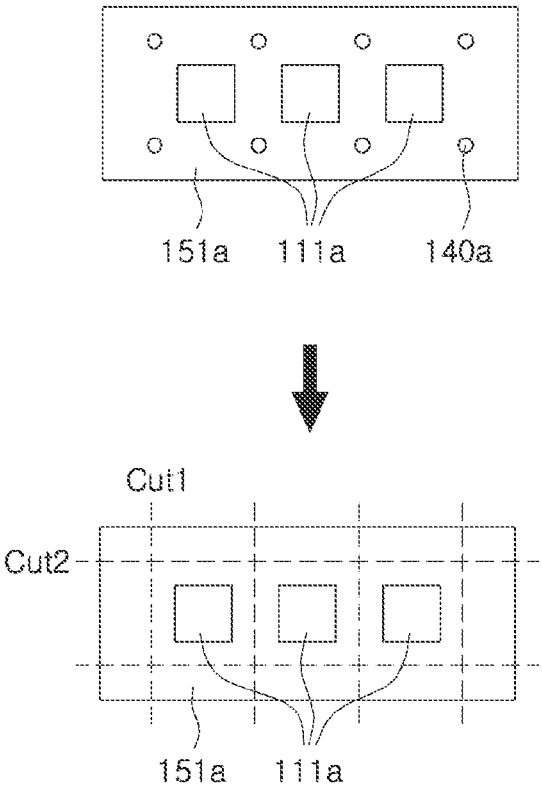

FIGS. 7A to 7C are views illustrating a method of manufacturing a chip antenna module, according to an embodiment.

Referring to FIG. 7A, a first dielectric layer 151*a* and a third dielectric layer 151*b* may be provided, a through-hole TH may be formed in a first dielectric layer 151*a*, and a conductive paste is applied to the through-hole TH or the through-hole TH is filled with a conductive paste to be form the first and second feed vias 121*a* and 122*a* as well as the shielding vias 130*a*.

Referring to FIG. 7B, the first patch antenna pattern 111*a* is formed by printing a pattern on the upper surface of the first dielectric layer 151*a* in a state of a conductive paste and drying the pattern. The second patch antenna pattern 112*a* is formed by printing a pattern on the lower surface of the third dielectric layer 151*b* in a state of a conductive paste and drying the pattern. The coupling patch pattern 115*a* is formed by printing a pattern on the upper surface of the third dielectric layer 151*b* in a state of a conductive paste and drying the pattern. The solder layer 140*a* is formed on the lower surface of the first dielectric layer 151*a* by printing a layer in a state of a conductive paste and drying the layer. Then, the second dielectric layer 152*a* may be formed on the upper surface of the first dielectric layer 151*a*, and the third dielectric layer 151*b* may be pressed on the second dielectric layer 152*a*.

Referring to FIG. 7C, the first patch antenna patterns 111*a* and a solder layer 140*a* may be formed on a single first dielectric layer 151*a*, and the first dielectric layer 151*a* may be cut along cut lines Cut1 and Cut2. Accordingly, multiple chip antenna modules may be simultaneously manufactured.

Figure 7D:
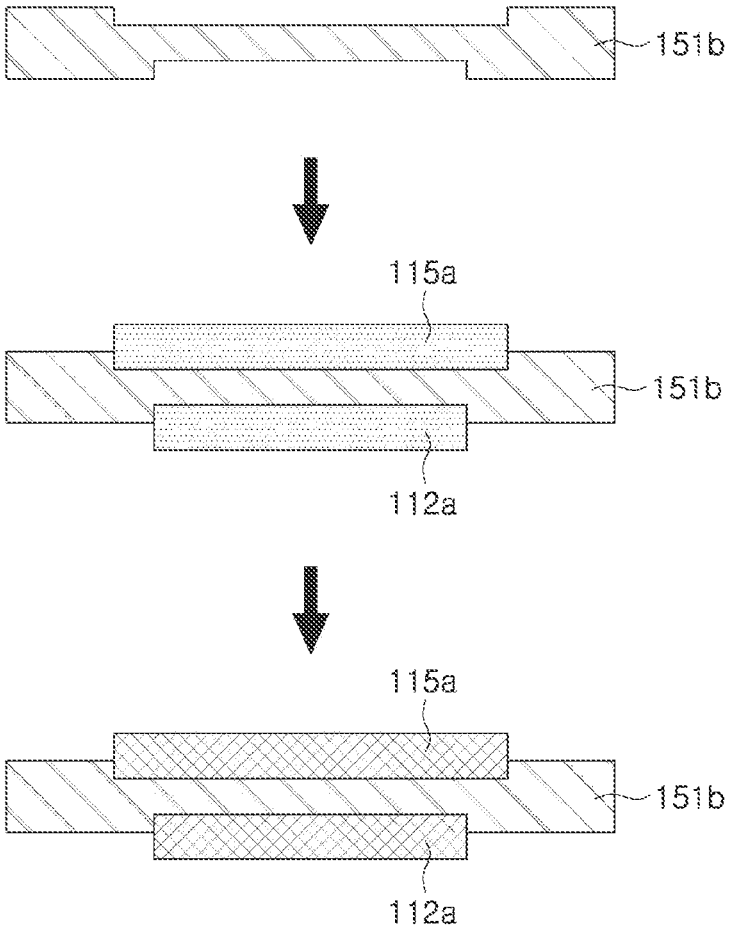
FIG. 7D is a view illustrating a process of forming an arrangement space of a patch antenna pattern of a dielectric layer of a chip antenna module, according to an embodiment.

FIG. 7D is a view illustrating a process of forming an arrangement space of a patch antenna pattern of a dielectric layer of a chip antenna module, according to an embodiment.

Referring to FIG. 7D, an upper surface and/or a lower surface of the third dielectric layer 151*b* may have a groove. The groove may be formed using laser processing for precision, but is not limited to being formed using laser processing.

The second patch antenna pattern 112*a* and/or the coupling patch pattern 115*a* may be printed and dried in the groove of the third dielectric layer 151*b*. Depending on the design, the groove may be formed in the first dielectric layer 151*a*.

Accordingly, a process variation between a first patch antenna pattern 111*a*, a second patch antenna pattern 112*a*, and/or a coupling patch pattern 115*a* may become smaller, and a separation distance between the first patch antenna pattern 111*a*, the second patch antenna pattern 112*a*, and/or the coupling patch pattern 115*a* may be optimized more precisely, so reliability of an antenna performance (for example: a gain and/or a bandwidth) may be further increased.

Figure 8A:
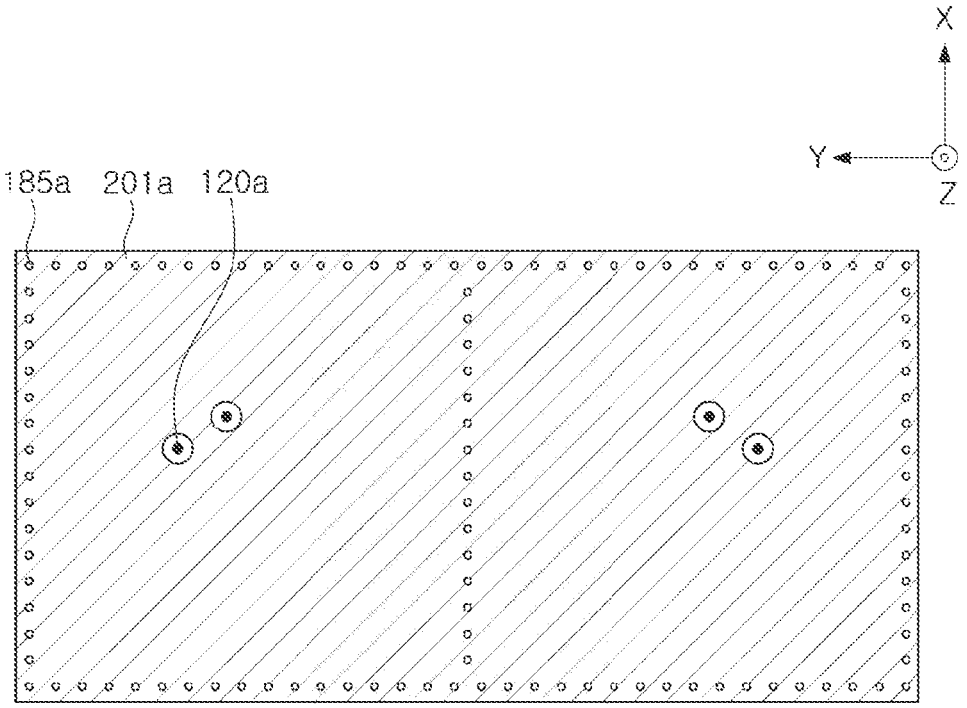
FIG. 8A is a plan view illustrating a first ground plane of a connection member included in an electronic device, according to an embodiment.
Figure 8B:
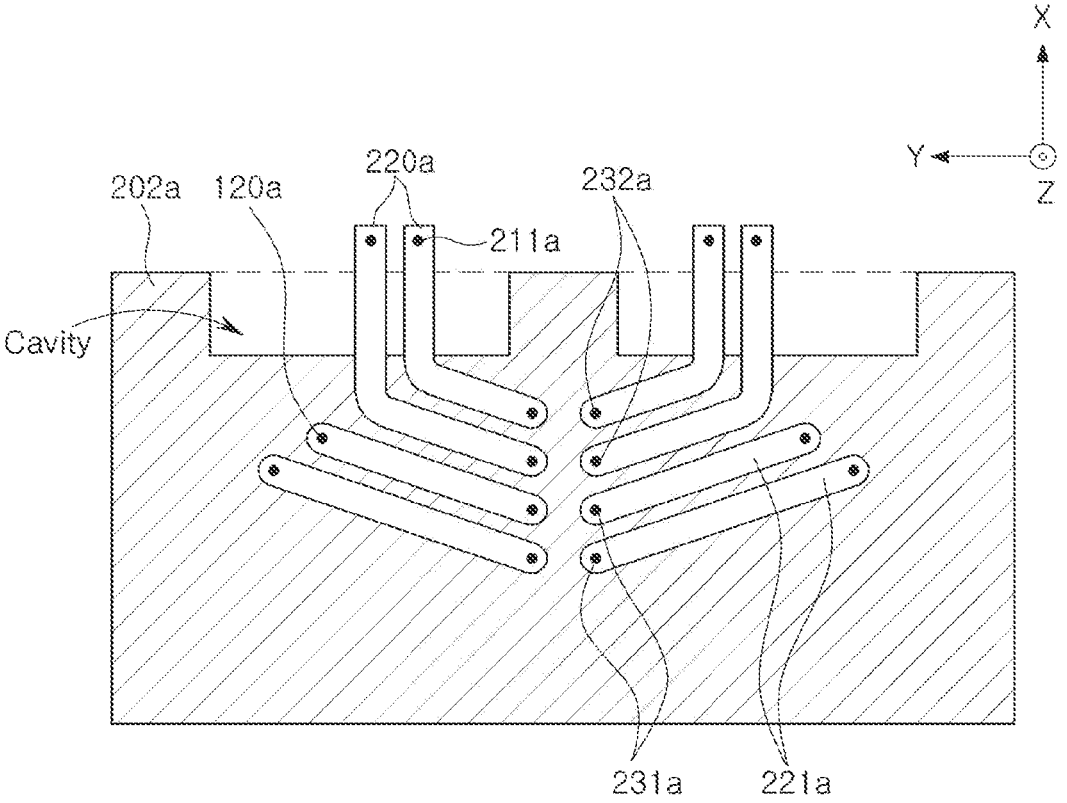
FIG. 8B is a plan view illustrating a feed line below the first ground plane of FIG. 8A, according to an embodiment.
Figure 8C:
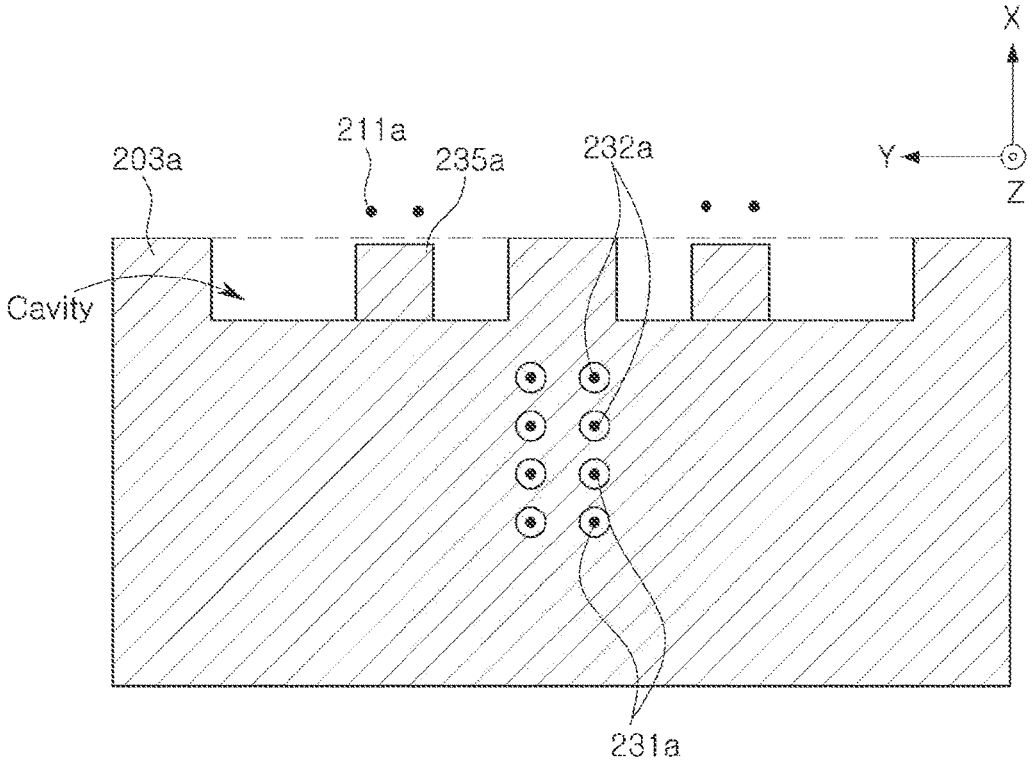
FIG. 8C is a plan view illustrating a wiring via and a second ground plane below the feed line of FIG. 8B, according to an embodiment.
Figure 8D:
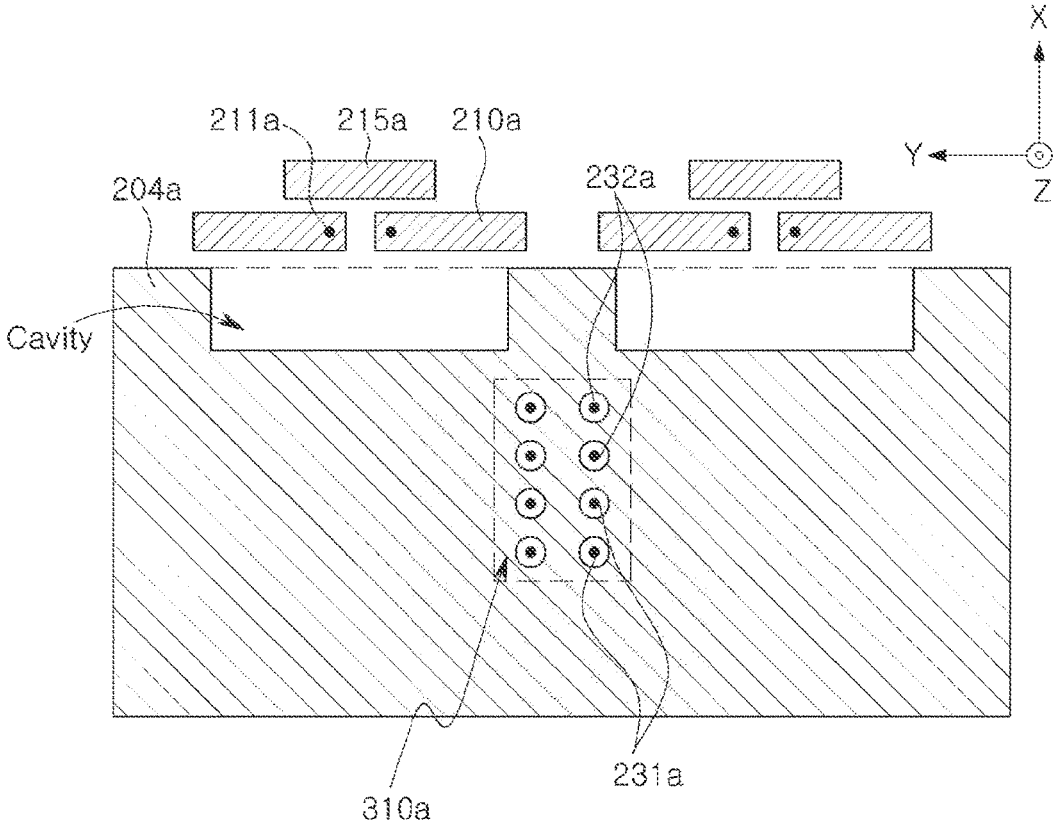
FIG. 8D is a plan view illustrating an IC arrangement and an end-fire antenna below the second ground plane of FIG. 8C, according to an embodiment.

FIG. 8A is a plan view illustrating the first ground plane 201*a* of a connection member included in an electronic device, according to an embodiment. FIG. 8B is a plan view illustrating a feed line 221*a* below the first ground plane 201*a* of FIG. 8A. FIG. 8C is a plan view illustrating a wiring via and the second ground plane 203*a* below the feed line of FIG. 8B. FIG. 8D is a plan view illustrating an IC arrangement and an end-fire antenna below the second ground plane 203*a* of FIG. 8C.

Referring to FIGS. 8A to 8D, the feed via 120*a* corresponds collectively to the first and second feed vias described above, and chip antenna modules may be arranged in a horizontal direction (for example: the X direction and/or the Y direction).

Referring to FIG. 8A, the first ground plane 201*a* may have a through-hole through which the feed via 120*a* passes, and may electromagnetically shield between the patch antenna pattern (e.g., the first and second patch antenna patterns 111*a* and 112*a*) and a feed line. The peripheral via 185*a* may be extended toward an upper side (for example: the Z direction), and may be connected to the second solder layer 180*a* described above.

Referring to FIG. 8B, the wiring ground plane 202*a* may surround at least a portion of each of the end-fire antenna feed line 220*a* and the feed line 221*a*. An end-fire antenna feed line 220*a* may be electrically connected to a second wiring via 232*a*, and the feed line 221*a* may be electrically connected to the first wiring via 231*a*. The wiring ground plane 202*a* may electronically shield between the end-fire antenna feed line 220*a* and the feed line 221*a*. One end of the end-fire antenna feed line 220*a* may be connected to a second feed via 211*a*.

Referring to FIG. 8C, a second ground plane 203*a* may have through-holes passing through each of the first wiring via 231*a* and the second wiring via 232*a*, and may have a coupling ground pattern 235*a*. The second ground plane 203*a* may electronically shield a feed line and an IC 310*a* (FIG. 8D).

Referring to FIG. 8D, the IC ground plane 204*a* may have through-holes passing through each of the first wiring via 231*a* and the second wiring via 232*a*. The IC 310*a* may be disposed below the IC ground plane 204*a*, and may be electrically connected to the first wiring via 231*a* and the second wiring via 232*a*. The end-fire antenna pattern 210*a* and the director pattern 215*a* may be disposed at substantially the same vertical level (for example: in the Z direction) as that of the IC ground plane 204*a*.

The IC ground plane 204*a* may form a ground, used in a circuit of the IC 310*a* and/or a passive component, as the IC 310*a* and/or the passive component. Depending on the design, the IC ground plane 204*a* may provide a transmission path of power and a signal used in an IC 310*a* and/or a passive component. Thus, the IC ground plane 204*a* may be electrically connected to the IC 310*a* and/or a passive component.

The wiring ground plane 202*a*, the second ground plane 203*a*, and the IC ground plane 204*a* may have a shape recessed to form a cavity. Accordingly, the end-fire antenna pattern 210*a* may be disposed to be closer to the IC ground plane 204*a* than would be possible in an embodiment in which the cavity was not formed.

The vertical relationship and shape of the wiring ground plane 202*a*, the second ground plane 203*a*, and the IC ground plane 204*a* may vary depending on the design.

Figure 9A:
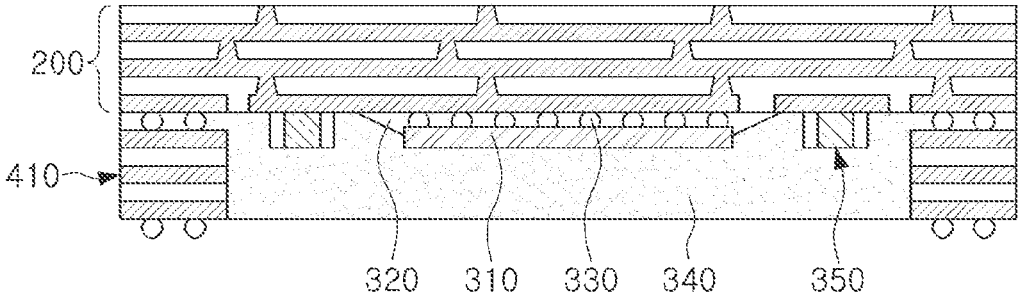
FIGS. 9A and 9B are side views illustrating a structure of a portion illustrated in FIGS. 8A to 8D and elements below the portion.
Figure 9B:
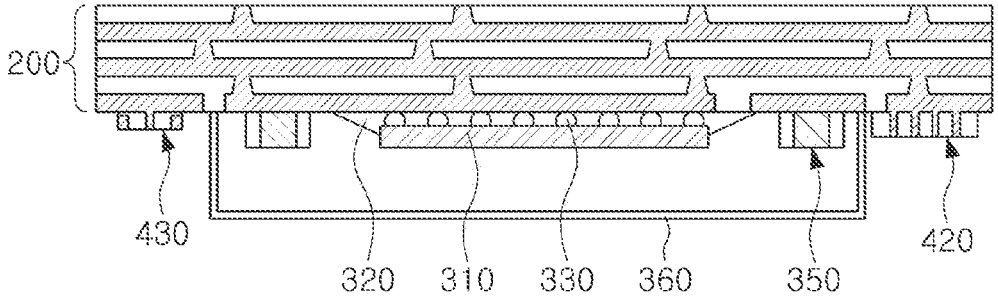

FIGS. 9A and 9B are side views illustrating a structure of a portion illustrated in FIGS. 8A to 8D and elements below the portion, according to an embodiment.

Referring to FIG. 9A, a chip antenna module, according to an embodiment, may include at least a portion of the connection member 200, the IC 310, an adhesive member 320, an electrical connection structure 330, an encapsulant 340, a passive component 350, and a core member 410.

The connection member 200 may have a structure similar to those described above with reference to FIGS. 1A to 7C.

The IC 310 is the same as described above, and may be disposed below the connection member 200. The IC 310 may be electrically connected to a wiring of the connection member 200 to transmit or receive an RF signal, and may be electrically connected to a ground plane of the connection member 200 to receive a ground. For example, the IC 310 may generate a signal converted by performing at least a portion among frequency conversion, amplification, filtering, phase control, and power generation.

The adhesive member 320 may allow the IC 310 and the connection member 200 to be bonded to each other.

The electrical connection structure 330 may allow the IC 310 and the connection member 200 to be electrically connected to each other. For example, the electrical connection structure 330 may have a structure such as a solder ball, a pin, a land, a pad, and the like. The electrical connection structure 330 has a melting point lower than those of a wiring and a ground plane of the connection member 200, and thus may allow the IC 310 and the connection member 200 to be electrically connected to each other through a process using the low melting point.

The encapsulant 340 may seal at least a portion of the IC 310, thereby improving heat dissipation performance and an impact protection performance of the IC 310. For example, the encapsulant 340 may be provided as a photo imagable encapsulant (PIE), an Ajinomoto build-up film (ABF), an epoxy molding compound (EMC), or the like.

The passive component 350 may be disposed on a lower surface of the connection member 200, and may be electrically connected to a wiring and/or a ground plane of the connection member 200 through the electrical connection structure 330. For example, the passive component 350 may include at least a portion among a capacitor (for example: a multilayer ceramic capacitor (MLCC)), an inductor, and a chip resistor.

The core member 410 may be disposed below the connection member 200, and may be electrically connected to the connection member 200 to receive an intermediate frequency (IF) signal or a baseband signal from an external source to transmit the IF signal or the baseband signal to the IC 310, or to receive an IF signal or a baseband signal from the IC 310 to transmit the IF signal or the baseband signal to an external source. Here, a frequency (for example: 24 GHz, 28 GHz, 36 GHz, 39 GHz, and 60 GHz) of the RF signal may be greater than a frequency of the IF signal (for example: 2 GHz, 5 GHz, 10 GHz, and the like).

For example, the core member 410 transmits an IF signal or a baseband signal to the IC 310 or receives the IF signal or the baseband signal from the IC 310 through a wiring included in an IC ground plane of the connection member 200. Since the first ground plane of the connection member 200 is disposed between an IC ground plane and a wiring, an IF signal or a baseband signal and an RF signal may be electrically isolated from each other in a chip antenna module.

Referring to FIG. 9B, a chip antenna module, according to an embodiment, may include at least a portion among a shielding member 360, a connector 420, and a chip antenna 430.

The shielding member 360 is disposed below the connection member 200, and may be disposed to confine the IC 310 together with the connection member 200. For example, the shielding member 360 may be disposed to cover (e.g., conformally shield) the IC 310 and the passive component 350, or may be disposed to cover (e.g., compartmentally shield) each of the IC 310 and the passive component 350. For example, the shielding member 360 has a hexahedral shape of which one side is open, and may have a hexahedral accommodation space through coupling with the connection member 200. The shielding member 360 is formed of a material having high conductivity such as copper to have a short skin depth, may be electrically connected to a ground plane of the connection member 200. Thus, the shielding member 360 may reduce an electromagnetic noise that the IC 310 and the passive component 350 receive.

The connector 420 may have a connection structure of a cable (for example: a coaxial cable, a flexible PCB), may be electrically connected to an IC ground plane of the connection member 200, and may perform a role similar to that of the core member 410 described above. That is, the connector 420 may receive an IF signal, a baseband signal, and/or power from a cable, or may provide the IF signal and/or the baseband signal to the cable.

The chip end-fire antenna 430 may transmit or receive an RF signal in support of the chip antenna module. For example, the chip end-fire antenna 430 may include a dielectric block having a dielectric constant greater than that of an insulating layer, and electrodes disposed on both sides of the dielectric block. One of the electrodes may be electrically connected to a wiring of the connection member 200, and another of the electrodes may be electrically connected to a ground plane of the connection member 200.

Figure 10A:
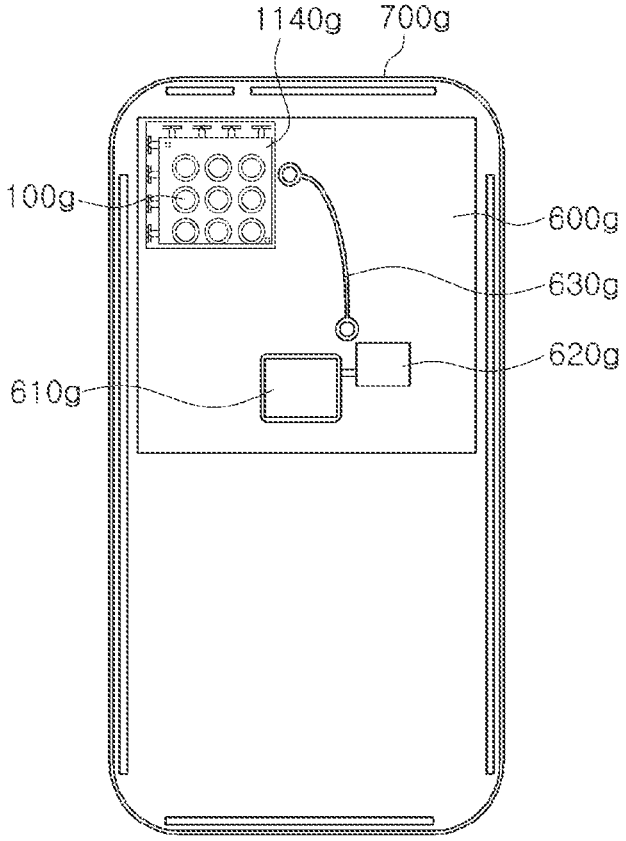
FIGS. 10A and 10B are plan views illustrating electronic devices including chip antenna modules, according to embodiments.
Figure 10B:
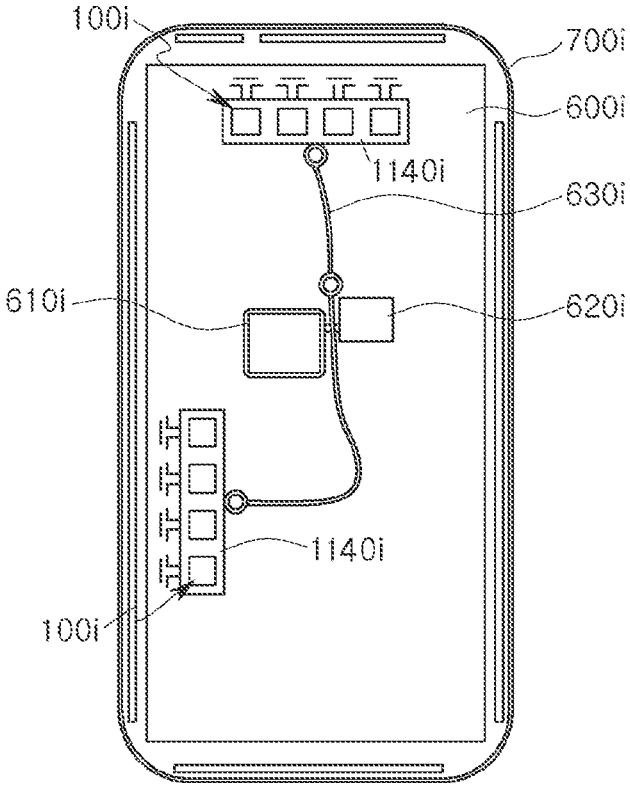

FIGS. 10A and 10B are plan views illustrating electronic devices including chip antenna modules, according to embodiments.

Referring to FIG. 10A, a chip antenna module including a patch antenna pattern 100*g* may be disposed adjacent to a boundary of a side surface of an electronic device 700*g* on a set substrate 600*g* of the electronic device 700*g*.

The electronic device 700*g* may be a smartphone, a personal digital assistant (PDA), a digital video camera, a digital still camera, a network system, a computer, a monitor, a tablet PC, a laptop PC, a netbook PC, a television, a video game machine, a smartwatch, an automotive component, or the like, but is not limited to the foregoing examples.

A communications module 610*g* and a baseband circuit 620*g* may also be disposed on the set substrate 600*g*. The chip antenna module may be electrically connected to the communications module 610*g* and/or the baseband circuit 620*g* through the coaxial cable 630*g*.

The communications module 610*g* may include at least a portion among a memory chip such as a volatile memory (for example, a dynamic random access memory (DRAM)), a non-volatile memory (for example, a read only memory (ROM)), a flash memory, or the like; an application processor chip such as a central processor (for example, a central processing unit (CPU)), a graphic processor (for example, a graphic processing unit (GPU)), a digital signal processor, a cryptographic processor, a microprocessor, a microcontroller, or the like; and a logic chip such as an analog-to-digital converter (ADC), an application-specific integrated circuit (ASIC), or the like to perform digital signal processing.

The baseband circuit 620*g* may generate a base signal by performing analog-to-digital conversion, amplification for an analog signal, filtering, and frequency conversion. The base signal, input and output from the baseband circuit 620*g*, may be transmitted to a chip antenna module through a cable.

For example, the base signal may be transmitted to an IC through an electrical connection structure, a core via, and a wiring. The IC may convert the base signal into an RF signal in a millimeter wave (mmWave) band.

Referring to FIG. 10B, chip antenna modules and antenna modules, each including a patch antenna pattern 100*i*, may be disposed adjacent to the center of a respective side of the polygonal electronic device 700*i* on the set substrate 600*i* of the electronic device 700*i*, and the communications module 610*i* and the baseband circuit 620*i* may also be disposed on the set substrate 600*i*. The chip antenna module and the antenna module may be electrically connected to the communications module 610*i* and/or the baseband circuit 620*i* through the coaxial cable 630*i*.

Referring to FIGS. 10A and 10B, a region in which a pattern, a via, a plane, a strip, a line, and an electrical connection structure are not disposed may be filled with a dielectric layer 1140*g* and 1140*i*, respectively, in the chip antenna module.

For example, the dielectric layer 1140*g*/1140*i* may be provided as a FR4, a liquid crystal polymer (LCP), low temperature co-fired ceramic (LTCC), a thermosetting resin such as an epoxy resin, a thermoplastic resin such as a polyimide resin, a resin in which the thermosetting resin or the thermoplastic resin is mixed with an inorganic filler or is impregnated together with an inorganic filler in a core material such as a glass fiber (or a glass cloth or a glass fabric), for example, prepreg, ABF, FR-4, BT, or the like, a photo imagable dielectric (PID) resin, a copper clad laminate (CCL), a glass or ceramic based insulating material, or the like.

The pattern, the via, the plane, the strip, the line, and the electrical connection structure, disclosed herein, may include a metal material (for example, copper (Cu), aluminum (Al), silver (Ag), tin (Sn), gold (Au), nickel (Ni), lead (Pb), titanium (Ti), alloys thereof, or the like), and may be formed using a plating method such as chemical vapor deposition (CVD), physical vapor deposition (PVD), sputtering, subtractive, additive, a semi-additive process (SAP), a modified semi-additive process (MSAP), or the like, but it is not limited to the foregoing materials and formation methods.

The RF signal disclosed herein may include protocols such as wireless fidelity (Wi-Fi) (Institute of Electrical and Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth®, 3G, 4G, and 5G protocols, and any other wireless and wired protocols, designated after the abovementioned protocols, but is not limited to these example protocols.

As set forth above, according to an embodiment, a chip antenna module and an electronic device including the chip antenna module provide a transmitting and receiving device with respect to frequency bands that are different from each other, while improving an antenna performance (e.g., a gain, a bandwidth, directivity, a transmission and reception rate, and the like) or easily implementing miniaturization.

The communication modules 610*g* and 610*i* in FIGS. 10A and 10B that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module, comprising:

a first dielectric layer;

a solder layer disposed on a lower surface of the first dielectric layer;

a first patch antenna pattern disposed on an upper surface of the first dielectric layer and having a through-hole;

a second patch antenna pattern spaced apart from an upper surface of the first patch antenna pattern and having an area less than an area of the first patch antenna pattern;

a first feed via extending from the lower surface of the first dielectric layer through the first dielectric layer, and electrically connected to the first patch antenna pattern;

a second feed via extending from the lower surface of the first dielectric layer through the first dielectric layer and the through-hole, and electrically connected to the second patch antenna pattern; and shielding vias extending from the lower surface of the first dielectric layer through the first dielectric layer, electrically connected to the first patch antenna pattern, and disposed on at least four sides of the second feed via.

2. The chip antenna module of claim 1, wherein the second feed via comprises two or more second feed vias, and wherein the shielding vias are arranged to at least partially surround the two or more second feed vias, respectively.

3. The chip antenna module of claim 1, wherein the first feed via is offset from a center of the first patch antenna pattern, and wherein the second feed via is disposed closer to the center of the first patch antenna pattern than the first feed via.

4. The chip antenna module of claim 1, further comprising:

a second dielectric layer disposed between the first and second patch antenna patterns, wherein a dielectric constant of the second dielectric layer is lower than a dielectric constant of the first dielectric layer.

5. The chip antenna module of claim 4, wherein a thickness of the second dielectric layer is less than a thickness of the first dielectric layer.

6. The chip antenna module of claim 4, wherein the second dielectric layer comprises a polymer, and wherein the first dielectric layer comprises a ceramic.

7. The chip antenna module of claim 4, further comprising:

a third dielectric layer disposed above the second dielectric layer, wherein a dielectric constant of the third dielectric layer is higher than a dielectric constant of the second dielectric layer.

8. The chip antenna module of claim 7, wherein a thickness of the third dielectric layer is greater than a thickness of the second dielectric layer and is less than a thickness of the first dielectric layer.

9. The chip antenna module of claim 8, further comprising:

a coupling patch pattern disposed on an upper surface of the third dielectric layer.

10. The chip antenna module of claim 1, further comprising:

a second dielectric layer disposed between the first and second patch antenna patterns; and a third dielectric layer disposed above the second dielectric layer, wherein a lower surface of the third dielectric layer forms an arrangement space of the second patch antenna pattern.

11. The chip antenna module of claim 10, further comprising:

an air cavity surrounded by the second dielectric layer.

12. An electronic device, comprising:

chip antenna modules;

a connection member comprising an upper surface to which a solder layer of each of the chip antenna modules is electrically connected; and an IC electrically connected to a lower surface of the connection member, wherein at least one of the chip antenna modules comprises:

a first dielectric layer;

a solder layer disposed on a lower surface of the first dielectric layer;

a first patch antenna pattern disposed on an upper surface of the first dielectric layer and having a through-hole;

a second patch antenna pattern spaced apart from an upper surface of the first patch antenna pattern and having an area less than an area of the first patch antenna pattern;

a first feed via extending from the lower surface of the first dielectric layer through the first dielectric layer, and electrically connected to the first patch antenna pattern;

a second feed via extending from the lower surface of the first dielectric layer through the first dielectric layer and the through-hole, and electrically connected to the second patch antenna pattern; and shielding vias extending from the lower surface of the first dielectric layer through the first dielectric layer, electrically connected to the first patch antenna pattern, and arranged to at least partially surround the second feed via.

13. The electronic device of claim 12, wherein the connection member further comprises:

a feed line electrically connecting the first feed via to the IC;

a wiring ground plane at least partially surrounding the feed line; and a first ground plane disposed between the wiring ground plane and the chip antenna modules.

14. The electronic device of claim 13, wherein the connection member further comprises:

a second solder layer disposed above the first ground plane and electrically connected to the solder layer; and a peripheral via connecting the second solder layer to the first ground plane.

15. The electronic device of claim 12, wherein the connection member further comprises:

a first ground plane disposed below the chip antenna modules; and end-fire antennas having at least a portion that is non-overlapping with the first ground plane below the first ground plane.

16. A chip antenna module, comprising:

a first dielectric layer;

a solder layer disposed on a lower surface of the first dielectric layer;

a connection member comprising a ground plane connected to the solder layer;

a first patch antenna pattern disposed on an upper surface of the first dielectric layer, and configured to transmit and receive signals in a first frequency band;

a second patch antenna pattern disposed above the first patch antenna pattern, and configured to transmit and receive signals in a second frequency band different from the first frequency band;

a first feed via extending through first dielectric layer, wherein one end of the first feed via is connected to a lower surface of the first patch antenna pattern, and another end of the first feed via is connected to the connection member;

a second feed via extending through the first dielectric layer and a through-hole in the first patch antenna pattern, wherein one end of the second feed via is connected to a lower surface of the second patch antenna pattern, and another end of the second feed via is connected to the connection member; and shielding vias disposed on at least four sides of the second feed via in the first dielectric layer, wherein one end of each of the shielding vias is connected to the lower surface of first patch antenna pattern and another end of each of the shielding vias is connected to the connection member.

17. The chip antenna module of claim 16, further comprising:

a second dielectric layer disposed between the first and second patch antenna patterns; and a third dielectric layer disposed above the second dielectric layer.

18. The chip antenna module of claim 17, wherein the second dielectric layer has a dielectric constant lower than dielectric constants of the first dielectric layer and the third dielectric layer.

19. The chip antenna module of claim 16, wherein the first feed via is offset from a center of the first patch antenna pattern by a distance greater than a distance by which the second feed via is offset from the center of the first patch antenna pattern.

20. A chip antenna module, comprising:

a first dielectric layer;

a solder layer disposed on a lower surface of the first dielectric layer;

a first patch antenna pattern disposed on an upper surface of the first dielectric layer and having a through-hole;

a second patch antenna pattern spaced apart from an upper surface of the first patch antenna pattern and having an area less than an area of the first patch antenna pattern;

a first feed via extending from the lower surface of the first dielectric layer through the first dielectric layer, and electrically connected to the first patch antenna pattern;

a second feed via extending from the lower surface of the first dielectric layer through the first dielectric layer and the through-hole, and electrically connected to the second patch antenna pattern; and shielding vias extending from the lower surface of the first dielectric layer through the first dielectric layer, electrically connected to the first patch antenna pattern, and arranged to at least partially surround the second feed via, wherein the second feed via comprises two or more second feed vias, and wherein the shielding vias are arranged to at least partially surround the two or more second feed vias, respectively.

* * * * *